US007789587B2

(12) United States Patent
James

(10) Patent No.: US 7,789,587 B2
(45) Date of Patent: Sep. 7, 2010

(54) ROAD SHOULDER WORKING APPARATUS

(76) Inventor: Edwin Harry James, 7050 Somenos Road, BC, Duncan (CA) V9L 5Z5

( * ) Notice: Subject to any disclaimer, the term of this patent is extended or adjusted under 35 U.S.C. 154(b) by 413 days.

(21) Appl. No.: 11/853,260

(22) Filed: Sep. 11, 2007

(65) Prior Publication Data

US 2008/0069639 A1 Mar. 20, 2008

Related U.S. Application Data

(63) Continuation-in-part of application No. 11/521,389, filed on Sep. 15, 2006, now abandoned.

(51) Int. Cl.
*E01C 19/12* (2006.01)

(52) U.S. Cl. ..... 404/96; 404/104; 172/172; 172/782; 172/787

(58) Field of Classification Search ..... 172/175, 172/195, 782, 785, 787, 791, 795; 404/101–104, 404/113, 118, 96

See application file for complete search history.

(56) References Cited

U.S. PATENT DOCUMENTS

| | | | | |
|---|---|---|---|---|
| 2,321,401 | A * | 6/1943 | Lull | 172/199 |
| 2,788,728 | A * | 4/1957 | Gray | 172/273 |
| 4,643,261 | A * | 2/1987 | Long | 172/2 |
| 5,108,221 | A | 4/1992 | Skibsted | |
| 5,304,013 | A | 4/1994 | Parsons | |
| RE34,860 | E * | 2/1995 | Skibsted | 404/128 |
| 5,810,097 | A | 9/1998 | McMillan | |
| 6,164,866 | A | 12/2000 | Wulff | |
| 6,293,354 | B1 | 9/2001 | Garratt et al. | |
| 6,612,774 | B1 | 9/2003 | Dulin | |
| 7,510,348 | B2 * | 3/2009 | James | 404/96 |
| 7,604,069 | B1 * | 10/2009 | Kobayashi | 172/784 |
| 2007/0098498 | A1 * | 5/2007 | James | 404/101 |

* cited by examiner

*Primary Examiner*—Gary S Hartmann
(74) *Attorney, Agent, or Firm*—Gowling Lafleur Henderson LLP

(57) ABSTRACT

A road shoulder working, grooming and compacting apparatus is configured to demountably cooperate with self-propelled operator-controlled machines. The apparatus comprises a first component for controllably working an outer portion of a road shoulder region to urge granular aggregate materials therefrom toward and onto a road surface, a second component positioned posterior to the first component and vertically movable between disengaged and engaged positions for controllably transferring granular aggregate material from a road surface to a road shoulder region, and a third component positioned posterior the second component for controllably distributing, grooming and compacting granular aggregate materials contained within the road shoulder region. The first and third components are movable between raised retracted positions and laterally-deployed lowered positions for engaging and working road shoulder regions while the self-propelled operator-controllable machine travels along a road surface. A fourth component is optionally provided interposed the second and third components for brushing road surfaces.

38 Claims, 21 Drawing Sheets

200
214
213
205
233
239
222
211
212
219
217
230
218
237
221
223
224
225
220

ROAD SHOULDER WORKING APPARATUS

CROSS-REFERENCE TO RELATED APPLICATION

This application is a continuation-in-part of my prior application Ser. No. 11/521,389 filed Sep. 15, 2006, currently pending.

FIELD OF THE INVENTION

This invention relates to an apparatus for working road shoulders. More particularly, this invention relates to an apparatus for working road shoulders comprising granular aggregate materials.

BACKGROUND OF THE INVENTION

Paved and concrete roadways are typically provided with shoulder regions which provide sufficient space to enable vehicles to safely pull off from the roadways for various reasons such as emergency repairs, driver and passenger rest, and parking. Road shoulders are typically supplied in the form of granular aggregate substrates such as gravel, crushed rock, sand, pebbles, crushed shells, crumbed waste rubber and other such materials and mixtures of such materials. Road shoulders comprising such granular aggregate materials must be significantly compacted in order to provide suitably dense matrices to support the weights of vehicles as they transition under some speed from the hard road surfaces to the road shoulders. During construction of new roads or re-surfacing of existing roads, the shoulder regions are prepared and worked by dispensing fresh aggregate materials adjacent the road surfaces after which, the road shoulders are worked to draw the aggregate materials against the road surfaces, then smoothed or groomed, and finally compacted by specialized equipment such as motor graders and self-propelled vibratory compacting rollers. Freshly worked and distributed road shoulders are typically very soft and susceptible to forming deep ruts caused by the wheels of equipment used for the initial grooming steps thereby resulting in uneven compacting and poor shoulder stability after compacting has been completed. Furthermore, the grooming steps often require the mouldboards of motor graders to move spilled or excess granular substrates from the surfaces of newly paved or poured road surfaces to the shoulders thereby often causing gouging, tearing or ripping of the newly paved or poured road surfaces which significantly reduces their durability and longevity. Attempts to solve these problems include the development of devices mountable onto dump trucks or specialized self-propelled equipment as exemplified in U.S. Pat. Nos. 5,304,013, 6,164,866, and 6,612,774, for creating and working road shoulders without requiring the trucks or equipment to leave the road surfaces.

Road shoulders are typically positioned adjacent to man-made ditches or gullies to facilitate water egress from the road surfaces. However, excessive rainfalls often result in the formation of rapidly flowing water channels that cut crevices and fissures into road shoulders thereby causing losses of the granular aggregate substrates into the ditches and gullies resulting in destabilization and deterioration of the road shoulders, thus creating hazardous conditions for vehicles transitioning from the road surfaces to the shoulders. Consequently, such road shoulders require regular periodic maintenance with specialized equipment to reclaim road shoulder substrates washed away into adjacent ditches and gullies, followed by their recycling back onto the road shoulder portions which are then reformed and compacted. For example, road shoulder substrates which have washed away into adjacent ditches and gullies may be recovered and transferred onto the road surface by a motor grader equipped with a gang of disc harrows as exemplified in U.S. Pat. No. 5,810,097, and then transferred back to the road shoulder portion by the grader mouldboard. The reclaimed road shoulders may then be worked and groomed by various types of devices as taught by U.S. Pat. Nos. 4,156,466 and 5,332,331, after which the groomed road shoulders may be compacted. However, such road shoulder reclaiming and reforming operations require at least two or more specialized self-propelled equipment such as motor graders that are provided with selected demountable devices adapted for working road shoulders wherein each operation is performed in a separate pass. Consequently, road shoulder forming and reclaiming operations are costly and time-consuming.

Another problem often encountered during road shoulder reclaiming operations is caused by the presence of debris or alternatively, vegetation that commonly establishes and proliferates at the outer margins of road shoulder surfaces and along their side edges sloping into the adjacent ditches and gullies. Such debris and vegetation are typically pulled in clumps onto road surfaces during the shoulder recovery operation, then re-distributed across the new shoulder surfaces formed as the granular aggregate materials are transferred back to the road shoulder regions, and then compacted into the newly formed road shoulders. The presence of debris and/or clumps of vegetation on and in newly worked road shoulders results in uneven compaction thereby resulting in unstable road shoulders that quickly deteriorate and subsequently, more frequently require costly and time-consuming road shoulder reclaiming and grooming operations.

SUMMARY OF THE INVENTION

The exemplary embodiments of the present invention, at least in some forms, are directed to the working, grooming and compaction of road shoulders.

According to an exemplary embodiment of the invention, there is provided a deployable retractable apparatus configured for demountably cooperating with a self-propelled operator-controlled machine, for engaging, disrupting and urging granular aggregate materials from an outer portion of a road shoulder region toward and partially onto a road surface, then transferring the granular aggregate materials from the road surface back onto the road shoulder region after which, the granular materials are distributed across the road shoulder region, groomed and compacted to form a densified substrate suitable to bear the weight of a vehicle transitioning from the road surface to the road shoulder region. The self-propelled operator-controlled machine is configured to travel along the road surface wherefrom the apparatus is laterally deployed to engage and work the road shoulder region.

According to one aspect of the invention, the apparatus is provided with a first component configured for engaging, disrupting and urging granular aggregate materials from an outer portion of a road shoulder region toward and partially onto a road surface. The first component comprises a frame mounting thereon a plurality of cooperating devices for engaging, disrupting and urging granular aggregate materials. The frame is movable between a retracted upward and inward raised position and a laterally-deployed and lowered position whereby the cooperating devices are arranged to controllably engage the outer portion of the road shoulder region.

In a suitable form, the plurality of cooperating devices mounted on the frame of the first component comprises a plurality of substantially parallel spaced apart discs. Each disc is provided with a cutting edge about its periphery arranged to engage a road shoulder for digging up and urging granular aggregate material towards a road surface when the first component is engaged with a road shoulder region.

In another suitable form, the plurality of cooperating devices mounted on the frame of the first component comprises a plurality of substantially parallel spaced apart ploughshares. Each ploughshare is configured with a leading cutting edge and a generally inward inclined concave following surface arranged to engage a road shoulder for digging up and urging granular aggregate material towards a road surface when the first component is engaged with a road shoulder region.

In a further suitable form, the plurality of cooperating devices mounted on the frame of the first component comprises a plurality of substantially parallel spaced apart elongate plates. Each plate is configured with a leading plate portion for cutting into a road shoulder and a generally inward inclined following plate portion arranged for digging, turning and urging granular aggregate material from the road should towards a road surface when said first component is engaged with a road shoulder region.

According to a second aspect of the invention, the apparatus is provided with a second component configured for transferring granular aggregate materials from the road surface onto the road shoulder region. The second component is positioned posterior to the first component.

In a suitable form, the second component is provided with a structural support communicating and cooperating with a mouldboard which extends below the structural support. The structural support is movable in a vertical axis between a raised retracted position and a lowered engaged position whereby the bottom edge of the mouldboard slidingly communicates with the road surface.

In another suitable form, the mouldboard is provided with a bottom edge having an upward inclined distal end portion.

In a further suitable form, the mouldboard is adjustable along the vertical axis by a cable communicating with the structural support.

According to a third aspect of the invention, the apparatus is provided with a third component provided for evenly distributing and grooming said granular aggregate materials across the road shoulder region and then compacting the groomed road shoulder region to form a densified substrate suitable for bearing the weight of a vehicle transitioning from the road surface to the road shoulder region. The third component is positioned posterior to the second component.

In a suitable form, the third component is provided with a framework mounting therein a plurality of rotatable cooperating devices extending therefrom for evenly distributing and grooming said granular aggregate materials across the road shoulder region and for compacting the groomed road shoulder region. The framework is movable between a retracted upward and inward raised position and a lowered, laterally-deployed engaged position wherein the rotatable cooperating devices are arranged to controllably engage and work the road shoulder region.

In another suitable form, the third component is provided with a framework having mounted therein a leading elongate augering roller for movably engaging a worked road shoulder region for distributing and grooming granular aggregate materials across the road shoulder region from a road surface edge to the outer portion of the road shoulder region when the third component is laterally deployed in an engaged position from a self-propelled operator-controlled machine travelling along a road surface adjacent said road shoulder region. A drive means is provided to one end of the augering roller for rotating the angering roller in a direction opposite to the direction of travel of the self-propelled operator-controlled machine. The augering roller is additionally useful for removing and discharging from the road shoulder region clumps of vegetation, rocks, debris and litter.

In a further suitable form, the third component is provided with a framework having mounted therein a following roller for compacting granular aggregate materials into the road shoulder region. If so desired, the compacting roller may be a vibratory roller. The compacting roller may be optionally provided with a longitudinally extending scraper blade for removing material from an outer surface of the roller. It is preferable the scraper blade is adjustably interconnected with the framework and that the scraper blade slidingly communicates with the compacting roller.

According to a fourth aspect of the invention, the apparatus is provided with a fourth component interposed the second and third components for sweeping granular aggregate materials left on a road surface by the second component, onto a road shoulder region in front of the third component.

In a suitable form, the fourth component comprises a rotary broom device, said rotary broom device movable in a vertical axis between a raised retracted position and a lowered engaged position for sweepingly engaging a road surface.

According to another exemplary embodiment of the invention, there is provided a deployable retractable apparatus configured for demountably cooperating with self-propelled operator-controlled machine, for engaging, disrupting and urging granular aggregate materials from an outer portion of a road shoulder region toward and partially onto a road surface with a first component, then transferring the granular aggregate materials from the road surface back onto the road shoulder region with a second component.

In a suitable form, the first component is provided with a frame that is pivotably engaged with a support structure of the second component wherefrom the first component is laterally extendable and pivotable for controllably engaging an outer portion of a road shoulder region and is retractable therefrom. The support structure of the second component is configured to demountably engage the undercarriage of a self-propelled operator-controlled machine.

According to another exemplary embodiment of the invention, the apparatus of the present invention when demountably cooperating with self-propelled operator-controlled machine, is provided with a plurality of cooperating hydraulically controlled actuators for concurrently but independently: (a) laterally deploying the first and third components cooperating with self-propelled operator-controlled machine on a road surface therefrom to a road shoulder region, (b) vertically and pivotably controlling the engagement of said laterally deployed components with the road shoulder portion, (c) retraction of said first and third components therefrom, (d) controlling the communication of the second component with the road surface, and (e) retraction of the second component therefrom.

In a suitable form, the first and second components are configured to demountably engage the undercarriage of a self-propelled operator-controlled machine, and the third component is configured to cooperatingly demountably engage the undercarriage and drive train components of a self-propelled operator-controlled machine. The third component is optionally configured to emountably engage the undercarriage of a self-propelled operator-controlled machine.

According to yet another exemplary embodiment of the invention, there is provided a self-propelled operated-controllable machine integrally provided with a deployable retractable apparatus configured for demountably cooperating with self-propelled operator-controlled machine, for engaging, disrupting and urging granular aggregate materials from an outer portion of a road shoulder region toward and partially onto a road surface, then transferring the granular aggregate materials from the road surface back onto the road shoulder region after which, the granular materials are distributed across the road shoulder region, groomed and compacted to form a densified substrate suitable to bear the weight of a vehicle transitioning from the road surface to the road shoulder region. The self-propelled operator-controlled machine is configured to travel along the road surface wherefrom the apparatus is laterally deployed to engage and work the road shoulder region.

BRIEF DESCRIPTION OF THE DRAWINGS

The present invention will be described in conjunction with reference to the following drawing, in which.

DETAILED DESCRIPTION OF THE INVENTION

Figure 1:
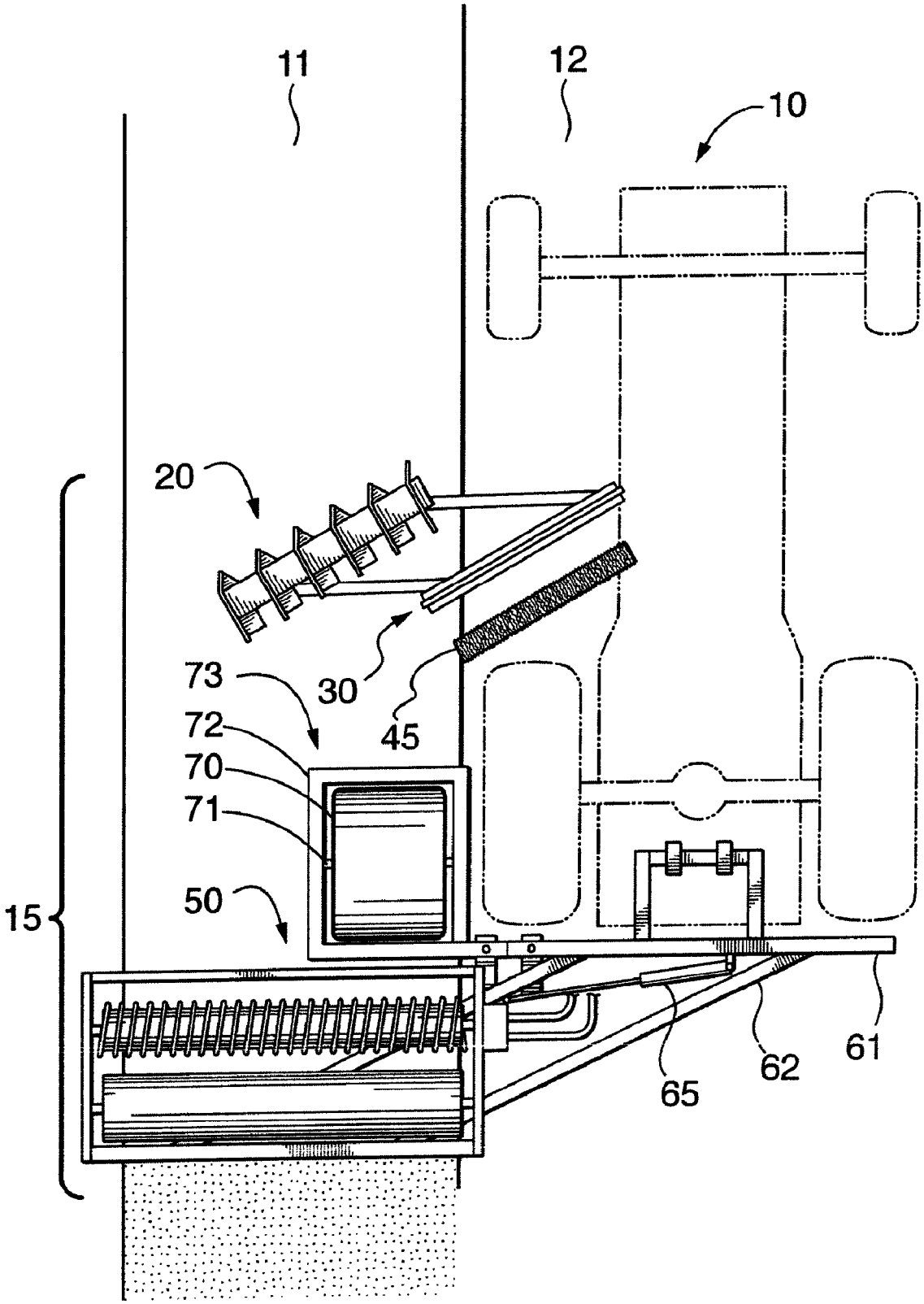
FIG. 1 is a bottom view of an exemplary embodiment of the present invention shown mounted on a tractor in deployed positions for engaging, working, and grooming road shoulders.

The accompanying drawings show an exemplary embodiment of the road shoulder working, grooming and compacting apparatus attached to a self-propelled operator-controllable machine, wherein the apparatus is generally referred to by the numeral 15 and the self-propelled operator-controllable machine is generally referred by the numeral 10. As can best be seen in FIGS. 1 and 2 which are bottom views looking up at the undercarriage of the machine 10, the apparatus 15 comprises a first component 20 configured for engaging an outer portion of a road shoulder region 11 by digging into, turning over and urging granular aggregate materials toward and onto a road surface 12, a second component 30 configured for transferring granular aggregate materials from the road surface 12 back onto the road shoulder region 11, a third component 50 configured for distributing and grooming granular aggregate materials across the surface of the road shoulder region 11. The apparatus 15 is optionally provided with a rotary broom device 45 preferably positioned between the road-shoulder transfer component 30 and road-shoulder grooming component 50 for sweeping granular aggregate materials left behind on the road surface 12 by the transfer component 30, onto the road shoulder region 11. The apparatus 15 may also be optionally provided with a packing wheel assembly 73 configured to cooperate with the fixed tractor-mounting framework 61 of the road-shoulder grooming component 50 (shown in FIGS. 1 and 11) to firm into place the granular aggregate material transferred to the road shoulder region by the transfer component 30 prior to grooming and further packing by the road-shoulder grooming component 50. As shown in FIG. 1, the road-shoulder engaging component 20 and road-shoulder grooming component 50 are laterally-deployable and outwardly-extendable from the operator's right side (shown on the left side in the bottom-up views of FIGS. 1 and 2) beyond the outside wheel base of the self-propelled machine 10 so that machine 10 can travel along on the surface 12 of a paved asphalt or poured concrete roadway while the road-shoulder engaging component 20 and road-shoulder transfer component 30 are controllably manipulated by the operator to engage, work and transfer granular aggregate materials situated in the road shoulder region 11 adjacent the roadway 12. The road-shoulder transfer component 30, the rotary broom device 45, and the packing wheel assembly 73 are controllably movable in a vertical axis whereby, when in lowered positions, the road-shoulder transfer component 30 slidingly engages the road surface 12 to transfer granular aggregate materials deposited thereon by the road-shoulder engaging component 20 to the road shoulder region 1, while the rotary broom device 45 brushes the road surface 12 to sweep granular materials left behind by the road-shoulder transfer component 30 onto the road shoulder region 11. The road-shoulder transfer component 30 the rotary broom device 45, and the packing wheel assembly 73 are vertically retractable from the road surface 12 when required or desired.

Figure 2:
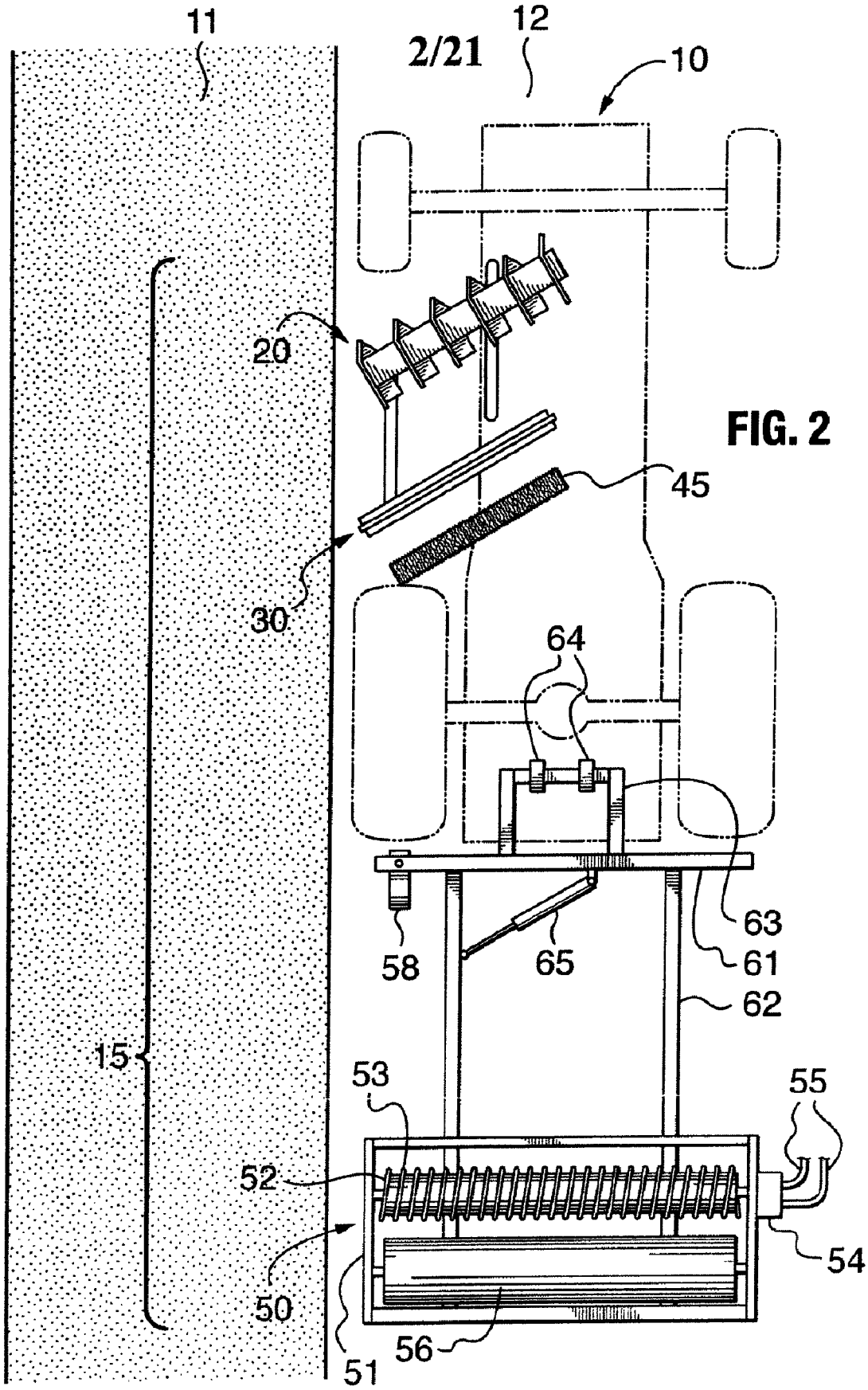
FIG. 2 is a bottom view of the embodiment from FIG. 1 shown in raised retracted positions.

As shown in FIG. 2, the road-shoulder engaging component 20 is laterally retractable to a position adjacent the machine 10 with only a small portion of component 20 extending beyond the wheelbase of machine 10, while the road-shoulder grooming component 50 is laterally retractable to a position directly behind machine 10. If so desired, the road-shoulder engaging, transfer and grooming components 20, 30 and 50 may comprise separate units that may be individually demountably coupled to a suitable self-propelled operator-controlled machine which, for example, may be a tractor, a motor grader, a dump truck or other such machine. Alternatively, it is possible within the scope of the present invention to combine two or more of the road-shoulder engaging, transfer and grooming components into one or more multifunctional components as will be described in more detail below. When the road-shoulder engaging, transfer and grooming components 20, 30 and 50 components are demountably coupled to a suitable machine, they can be independently and concurrently deployed, operated and controlled by various types of actuators communicating with one or more hydraulic, pneumatic, electronic, electrical and mechanical control systems known to those skilled in this art. When the road-shoulder engaging, transfer and grooming components 20, 30 and 50 are retracted, the self-propelled machine 10 may be driven away from the job site by the operator or, alternatively, may be driven onto a flat-bed trailer for conveyance away from the job site.

Figure 3A:
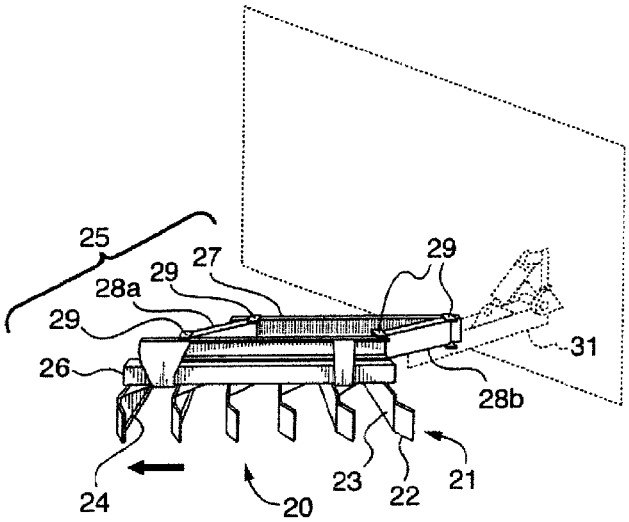
FIG. 3*a* is a perspective view from the front, of an exemplary embodiment for a road shoulder-engaging component of present invention, shown in a deployed position.
Figure 3B:
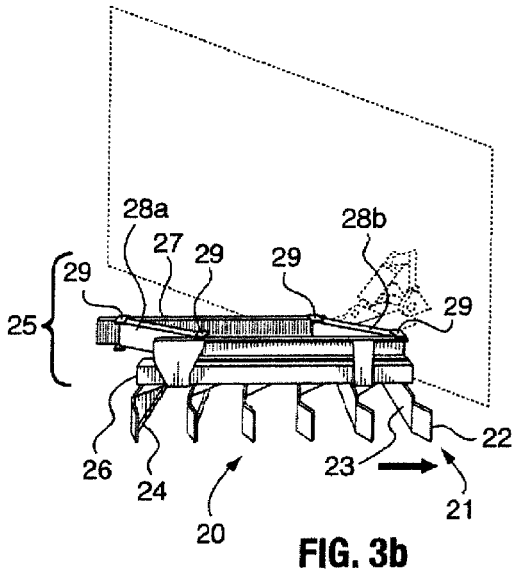
FIG. 3*b* is a perspective view from the front of the embodiment from FIG. 3*a*, shown in a retracted position.
Figure 4:
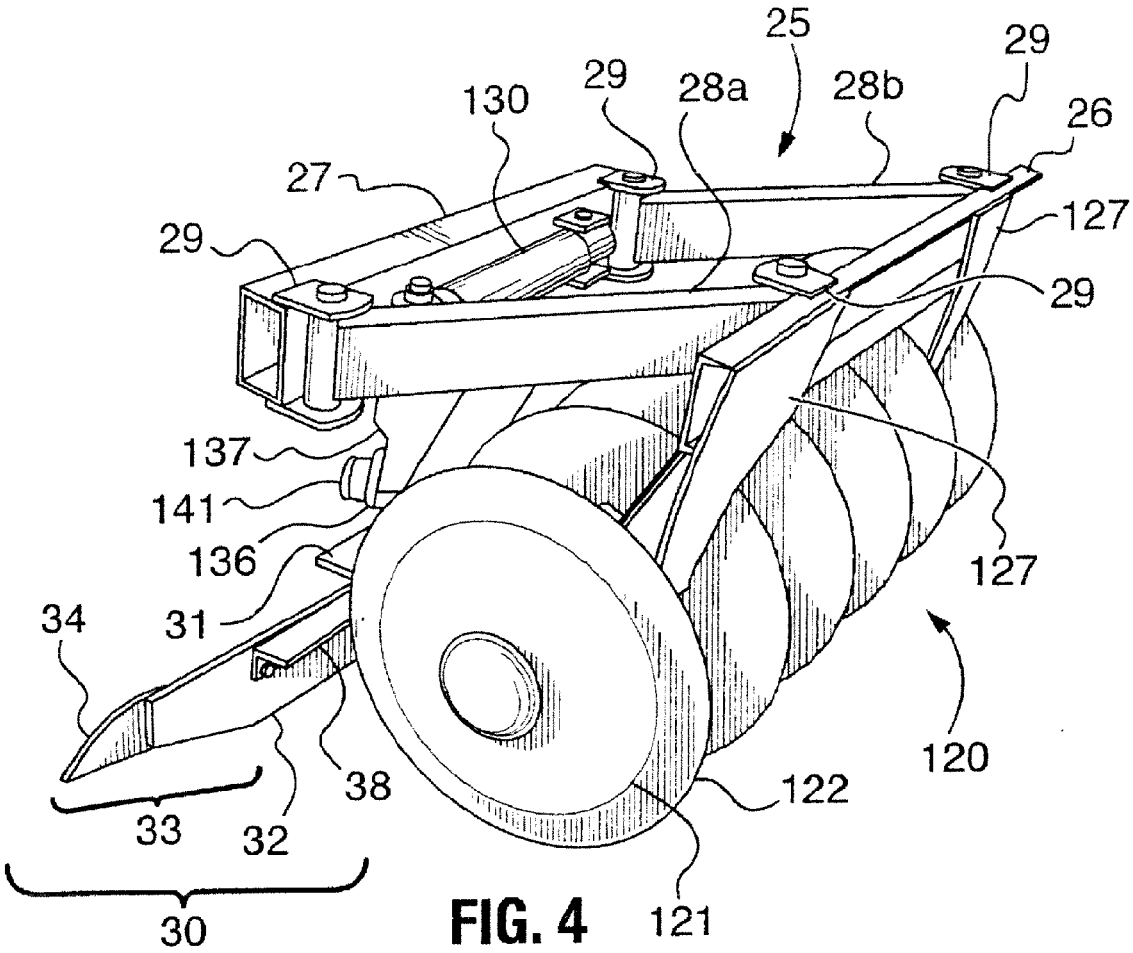
FIG. 4 is a perspective view from the side, of an alternative exemplary embodiment for a road shoulder-engaging component of present invention, shown in combination with a road shoulder transfer component.

A particular embodiment of the present invention is illustrated in FIGS. 3*a*, 3*b* and 4 showing the road-shoulder engaging component 20 mounted on the right side of a machine (for simplicity represented by a rectangle with broken lines) and viewed from the front right-side of the machine 10 (not shown). It is to be noted that FIG. 3*a* shows the road-shoulder engaging component 20 in the deployed position and FIG. 3*b* shows the road-shoulder engaging component 20 in the retracted position as indicated by the arrows in the drawings. The road-shoulder engaging component 20 comprises an articulating frame 25 provided with a rear mounting beam 27, two opposing articulating side rails 28*a* and 28*b* hingedly interconnected with the rear mounting beam 27 via hinge units 29, while the other ends of the opposing articulating side rails 28*a* and 28*b* are hingedly interconnected with an enlongate beam, shown by the numeral 26 via hinge units 29. The elongate beam 26 is laterally deployable and retractable relative to rear mounting beam 27 by a hydraulic cylinder 130 as shown in FIG. 4.

Referring again to FIGS. 3*a* and 3*b*, the road-shoulder engaging component of the present invention is provided with a plurality of spaced-apart downward projecting plates 21 mounted on an elongate beam 26 for engaging and working road shoulder regions. Each plate 21 comprises a vertically-oriented leading edge plate portion 22 for cutting into and slicing through a road shoulder comprising granular aggregate materials, and a vertically-oriented following plate portion 23 integrally adjacent to and interconnected with leading-edge plate portion 22 at an inclined angle selected such that granular aggregate materials cut into by leading-edge plate portion 22 are turned over and urged toward the road surface. The bottom edge 24 of the following plate portion 23 may be optionally inclined at an angle toward the road surface to enhance and facilitate the turning over and urging of the granular aggregate road shoulder materials by following plate portion 23. It is to be noted that the plurality of spaced-apart shoulder-engaging plates 21 may be substituted, for example, by a plurality of spaced-apart ploughshare-shaped units (not shown) within the scope of the present invention.

A road-shoulder engaging component 20 may be optionally provided with a plurality of spaced-apart rotatable concave discs 121 axially attached to elongate beam 26 by support elements 127 as shown in FIG. 4. Each rotatable disc 121 is provided with a leading edge portion 122 configured for cutting into, turning over, and urging granular aggregate material from a road shoulder region toward a road surface.

Figure 5A:
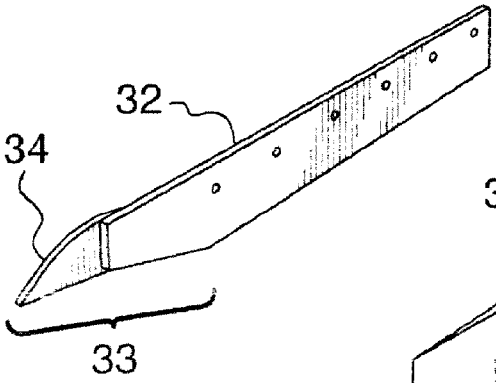
FIGS. 5*a* and 5*b* are perspective views of alternative embodiments for a road shoulder transfer component of the present invention shown in FIG. 4.
Figure 5B:
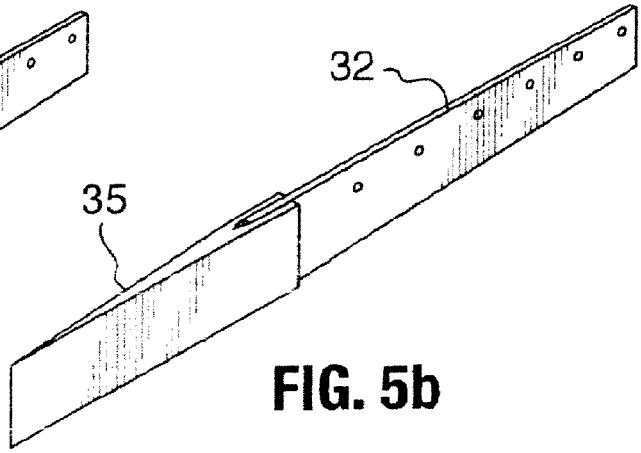
Figure 6A:
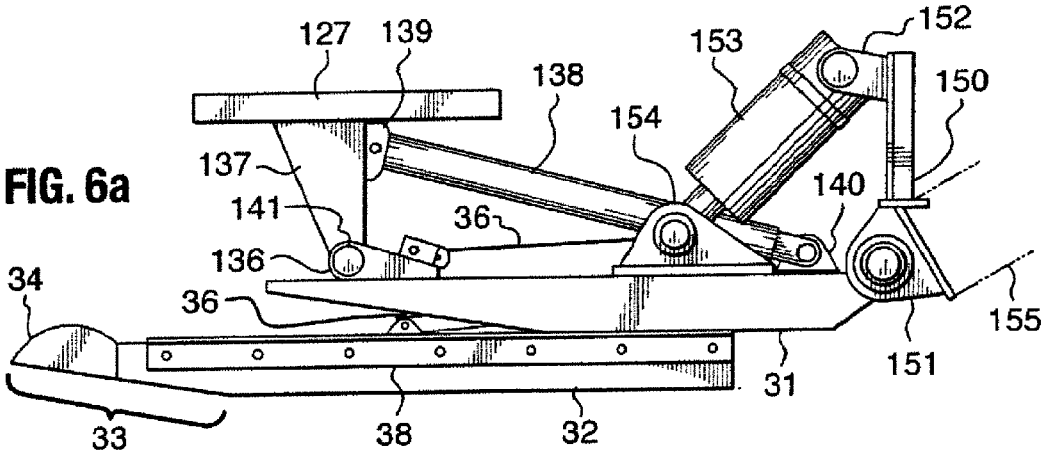
FIG. 6*a* is a partial front view of an exemplary embodiment configured for raising and lowering the embodiments shown in FIGS. 5*a* and 5*b;*
Figure 6B:
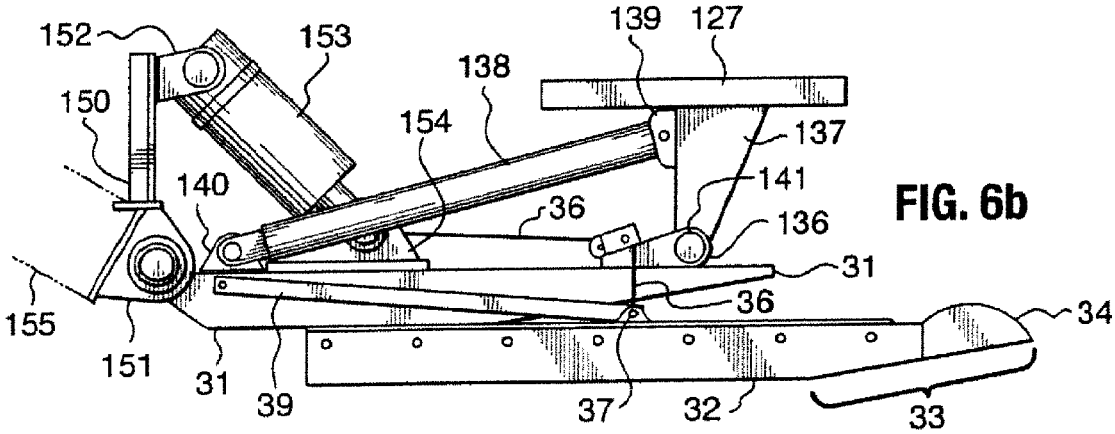
FIG. 6*b* is a partial rear view of the embodiment shown in FIG. 6*a;*

Preferred embodiments for the road-shoulder transfer component 30 are shown in FIGS. 4, 5*a*, 5*b*, 6*a* and 6*b*, wherein the road-shoulder transfer component 30 comprises a mounting plate 31 configured for cooperating with a mouldboard 32. The mouldboard 32 may be directly interconnected with the mounting plate 31 as shown in FIG. 4, or alternatively, the mouldboard 32 can be lowered from and retracted to mounting plate 31 by an actuator-controllable cable 36 (as illustrated in FIGS. 6*a* and 6*b*) interconnected with a yoke 37 mounted onto a flange 38 to which the mounting plate 32 is securely fixed. A stabilizer bar 39 is pivotably interconnected with the yoke 37 and the mounting plate 31 to stabilize the mouldboard 32 when lowered from mounting plate 31 by cable 36 for road surface working operations. As shown in FIGS. 4 and 5*a*, the mouldboard 32 may be provided with an upwardly inclined distal portion 33. An optional upwardly inclined distal tip 34 may be detachably engaged with the mouldboard 32 to extend the length of the upwardly inclined distal portion 33. In operation, the machine 10 is preferably operated so that the juncture of the bottom edge of mouldboard 32 and the upwardly extending portion 33 runs along the juncture of the road surface and the road shoulder region thereby causing an upwardly sloping edge or ridge of granular aggregate materials to be formed immediately adjacent the road surface, the benefits of which will be explained in more detailed below. Alternatively, if so desired, the mouldboard 32 may be provided with a straight bottom edge which is extendable by a tip 35 also provided with a straight bottom edge, as illustrated in FIG. 5*b*. It has been surprisingly found that, in contrast with the prior art which teaches that mouldboards for working road shoulders and road surfaces should have lengths ranging from at least 1.8 m to 2.4 m (i.e., 6 ft. to 8 ft.) or longer for satisfactory working of road shoulders and road surfaces, relatively short mouldboards from within the range of 45 cm to 102 cm (18 in. to 40 in.) are suitable for transferring granular aggregates urged onto road surfaces during road shoulder working operations, back onto road shoulder regions. Such short mouldboards weigh significantly less than the commonly known prior art mouldboards and therefore are significantly less bulky and easier to manipulate during road shoulder and road surface working and grooming operations. Furthermore, such lightweight short mouldboards minimize and, for the most part, eliminate gouging and ripping damage commonly encountered with the prior art mouldboards when they are used on paved or poured road surfaces.

Figure 8A:
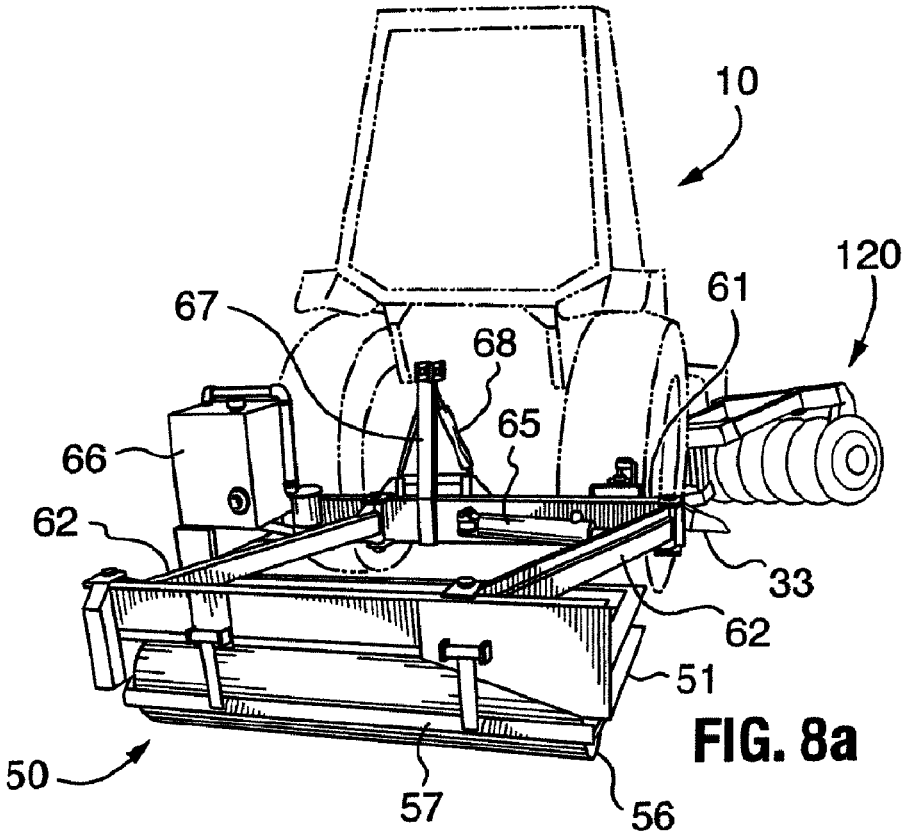
FIG. 8*a* is a rear view showing the embodiment from FIG. 4 in a laterally-deployed position with the outer edge in a raised position, while the embodiment from FIG. 7*a* is in a retracted position.
Figure 8B:
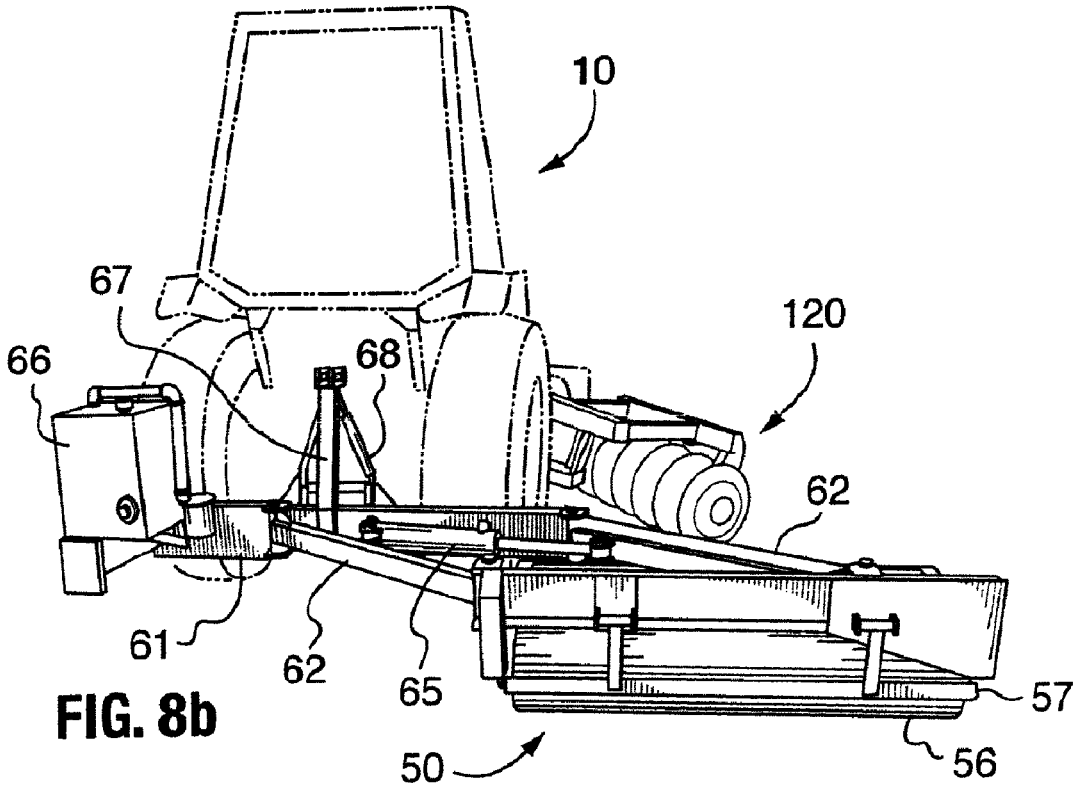
FIG. 8*b* is a rear view showing the embodiments from FIGS. 4 and 7*a* in laterally-deployed positions.

It is to be noted that FIGS. 4, 6*a* and 6*b* illustrate means for combining the road-shoulder engaging and transfer components 20 and 30 into a single demountable unit 120 configured for coupling to a suitable self-propelled operator-controlled machine. The articulating frame 25 is pivotably interconnected to the mounting plate 31 via a yoke 136 wherein the rear-mounting beam 27 of the articulating frame 25 is securely engaged with one end of a pivotable strut 137, while the other end of the pivotable strut 137 is pivotably connected with the yoke 136 by a hinge pin 141. The articulating frame 25 can be controllably pivoted around a fulcrum point formed by the interconnection of the yoke 136 and the pivotable strut 137 with the hinge pin 141, by extension of hydraulic cylinder 138 interconnected with a yoke 140 provided on the mounting plate 31 and a second yoke 139 provided near the top of the pivotable strut 137, thereby lowering the distal end of articulating frame 25, i.e., shown as articulating side rail 28*a* while raising the proximal end shown as articulating side rail 28*b* (refer to FIG. 8*a*). Retracting the hydraulic cylinder 138 raises the distal end of articulating frame 25 while lowering the proximal end (refer to FIG. 5*b*). The mouldboard 32 can be concurrently yet independently operated, i.e., lowered and raised from the mounting plate 31 with cable 36 as shown in FIGS. 6*a* and 6*b*. A mounting beam structure 155 which is configured for demountably coupling to a suitable self-propelled operator-controlled machine, is provided with a lower yoke 151 for hingedly interconnecting with the mounting plate 31, the lower yoke 151 interconnected with a support beam 150 to an upper yoke 152. A hydraulic cylinder 153 interconnects the upper yoke 152 of the mounting beam structure 155 with yoke 154 integrally situated on a top portion of the mounting plate 31, thus enabling controllable concurrent raising and lowering of the road-shoulder engaging and transfer components 20 and 30 of the demountable road-shoulder engaging/transfer unit 120 while they are independently and concurrently operated for engaging road shoulders with the hydraulic cylinder 138, and for transferring granular aggregate materials from road surfaces to road shoulders by cable 36.

Yet another particular embodiment of the present invention is illustrated in FIGS. 1, 2, 7, 8 and 9 wherein the road-shoulder grooming component 50 is configured for distributing and grooming granular aggregate materials across a road shoulder region and for compacting the granular aggregate materials into the road shoulder region. As shown in FIGS. 7*a* and 7*b*, the road-shoulder grooming component 50 comprises a rectangular framework 51 interconnected by articulating side rails 62 to a support beam 61 from which extends a mounting framework 63 configured to demountably couple to the rear of a self-propelled machine in cooperation with a 3-point hitch 67. The 3-point hitch 67 is provided with two attachment devices 64, best seen in FIG. 2, for releasingly engaging suitable attachment points (not shown) provided therefore on the machine 10. A hydraulic cylinder 65 interconnects one articulating side rail 62 with support beam 61 for lateral deployment of the road-shoulder grooming component 50 outside the rear wheel of machine 10 as shown in FIGS. 1 and 8*b*, and for retraction of the road-shoulder grooming component 50 to a position directly behind machine 10 as shown in FIGS. 2 and 8*a*.

Figure 7A:
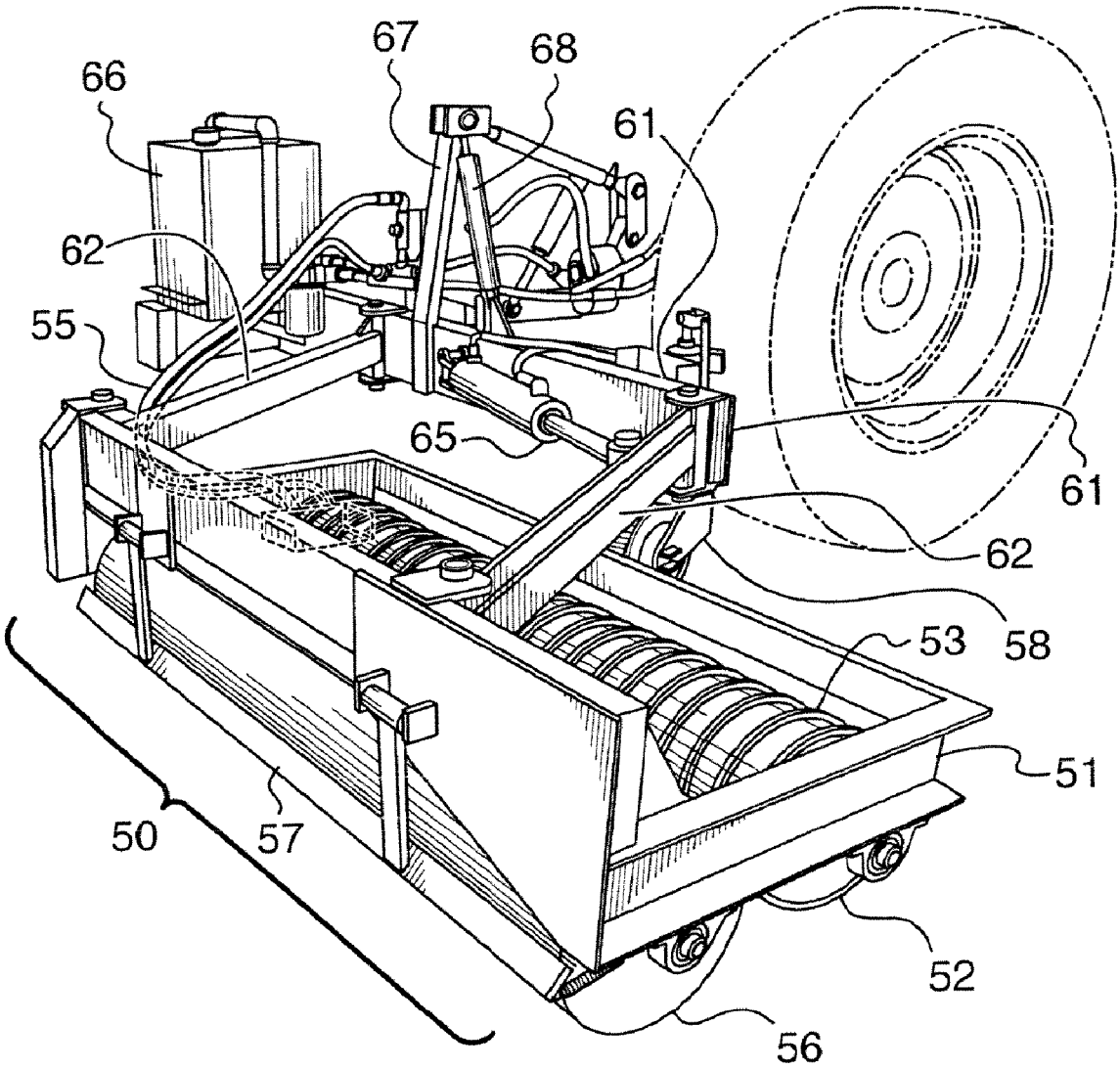
FIG. 7*a* is a perspective view of an exemplary embodiment for a road shoulder-grooming component of the present invention, shown from the right rear.
Figure 7B:
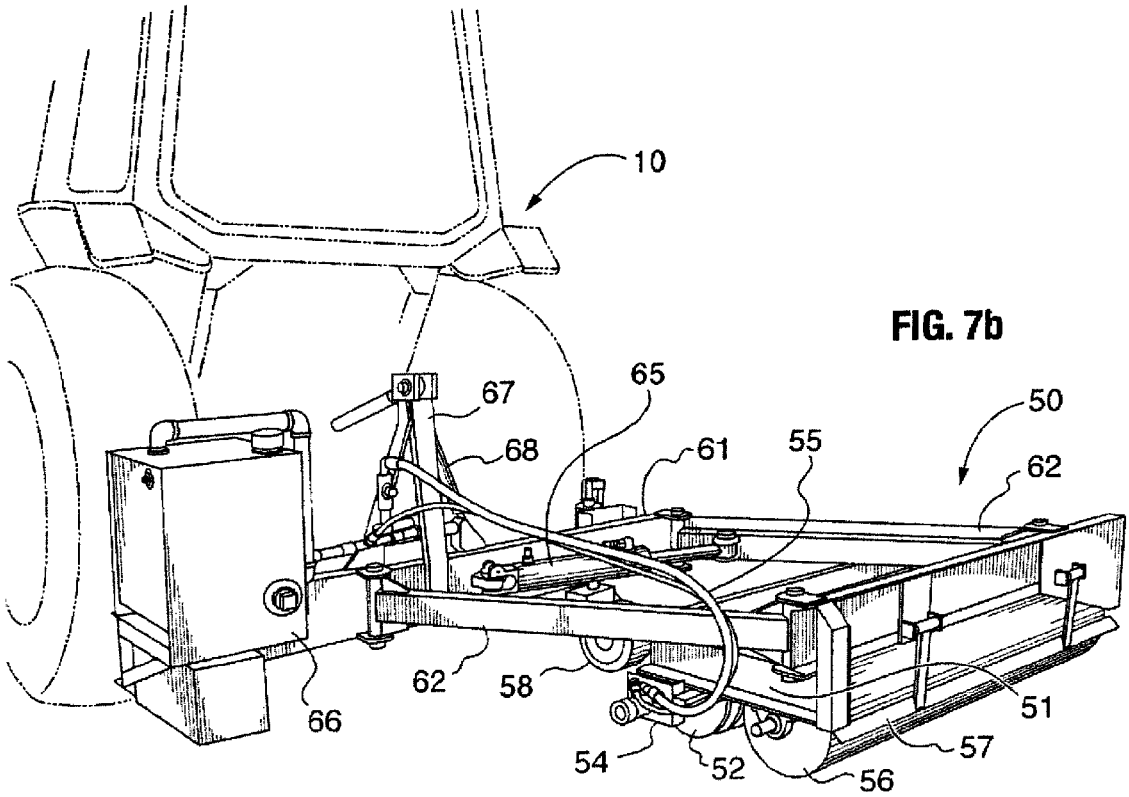
FIG. 7*b* is perspective view of the embodiment from FIG. 7*a*, shown from the left rear.
Figure 9A:
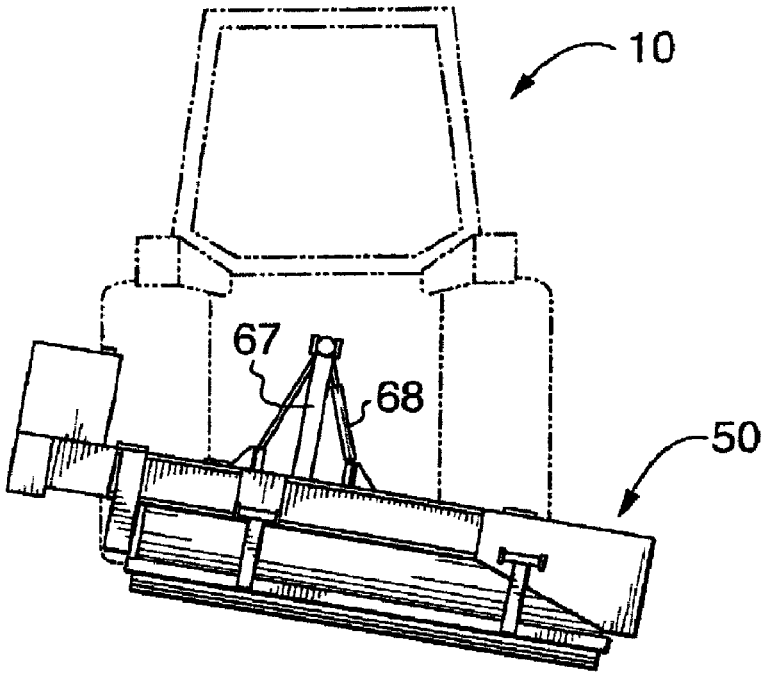
FIGS. 9*a* and 9*b* show the embodiment from FIG. 7*a*, pivotably positioned in opposing directions.
Figure 9B:
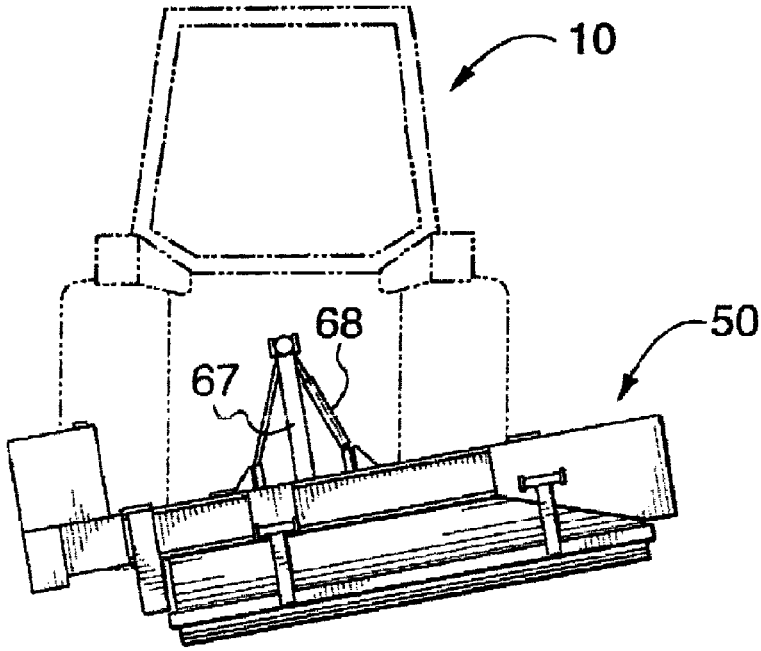

As best seen in FIGS. 2, 7*a* and 7*b*, a leading roller 52 is rotatably mounted within the front section of framework 51 wherein the leading roller 52 is integrally provided with an augered surface 53 for working, distributing and grooming road shoulders. One end of the leading roller 52 is fitted to a hydraulic drive mechanism 54 mounted to the framework 51. The hydraulic drive mechanism 54 is interconnected to a hydraulic oil reservoir 66 with hydraulic hoses 55 along with suitable requisite pumps, valves, actuators and instrumentation (not shown) known to those skilled in this art. The hydraulic drive mechanism 54 is configured to rotate leading roller 52 in a direction opposite to the direction of whereby the configuration of the augered surface 53 moves materials transferred to the road shoulder from the road surface, outward from the inboard side of framework 51, i.e., the side closest to the hydraulic oil reservoir 66, to the outboard side of framework 51 thereby providing means for evenly distributing granular aggregate materials transferred from the road surface across the road shoulder region, and for transferring and clumps of vegetation from the road shoulder surface and discharging the clumps from underneath the outboard side of framework 51 adjacent the outer edge of the road shoulder region. A smooth-faced following roller 56 is rotatably mounted within the back section framework 51 behind the leading augered roller 52. It is preferable that a scraper plate 57 is adjustably mounted onto the rear of the framework 51 so that it slidingly communicates with the smooth-faced following roller 56 for removing any granular aggregate materials adhering thereto the smooth-faced following roller 56. Those skilled in this art will understand the smooth-faced following roller 56 can be a vibratory roller having one end fitted to a hydraulic drive mechanism mounted onto the framework 51 (not shown) configured and interconnected with the hydraulic oil reservoir 66. As shown in FIGS. 2, 7*a* and 7*b*, it is suitable to provide a pivotable supporting wheel assembly 58 disposed downward from support beam 61, configured for providing stability to the road-shoulder grooming component 50 when it is lowered into a working mode. As best can be seen in FIGS. 8*a*, 8*b*, 9*a* and 9*b*, one side element of the three-point hitch 67 is preferably a hydraulic cylinder 68. Extension of the hydraulic cylinder 68 will cause one lateral side of the articulating framework 51 to be lower than the opposite side as shown in FIG. 9*a*, while retraction of the hydraulic cylinder 68 will cause the same lateral side to be elevated with respect to the opposite side as shown in FIG. 9*b*.

Figure 10A:
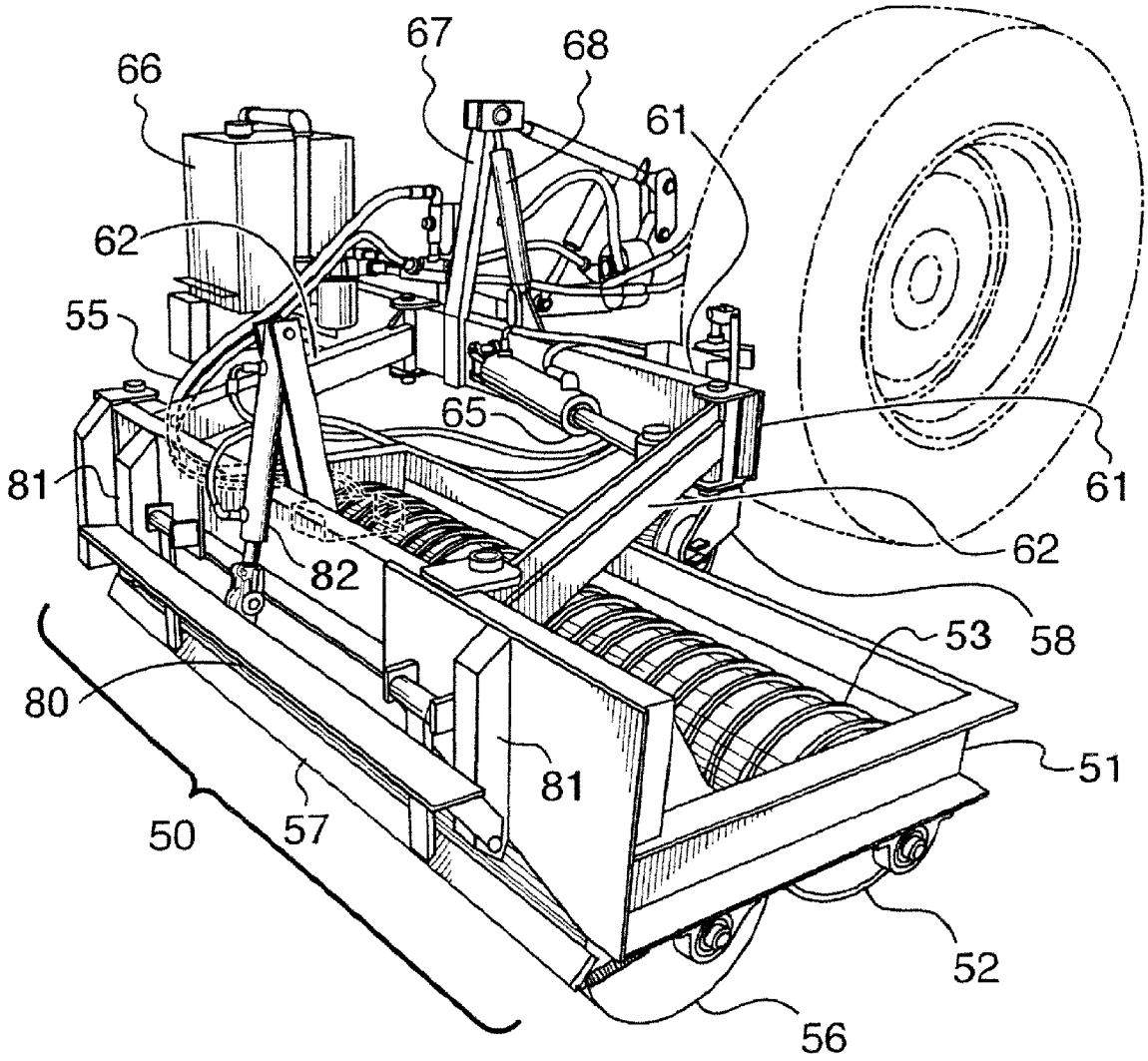
FIG. 10*a* is a perspective view from the rear showing an exemplary embodiment for a rear-ward facing grading blade in a retracted position.
Figure 10B:
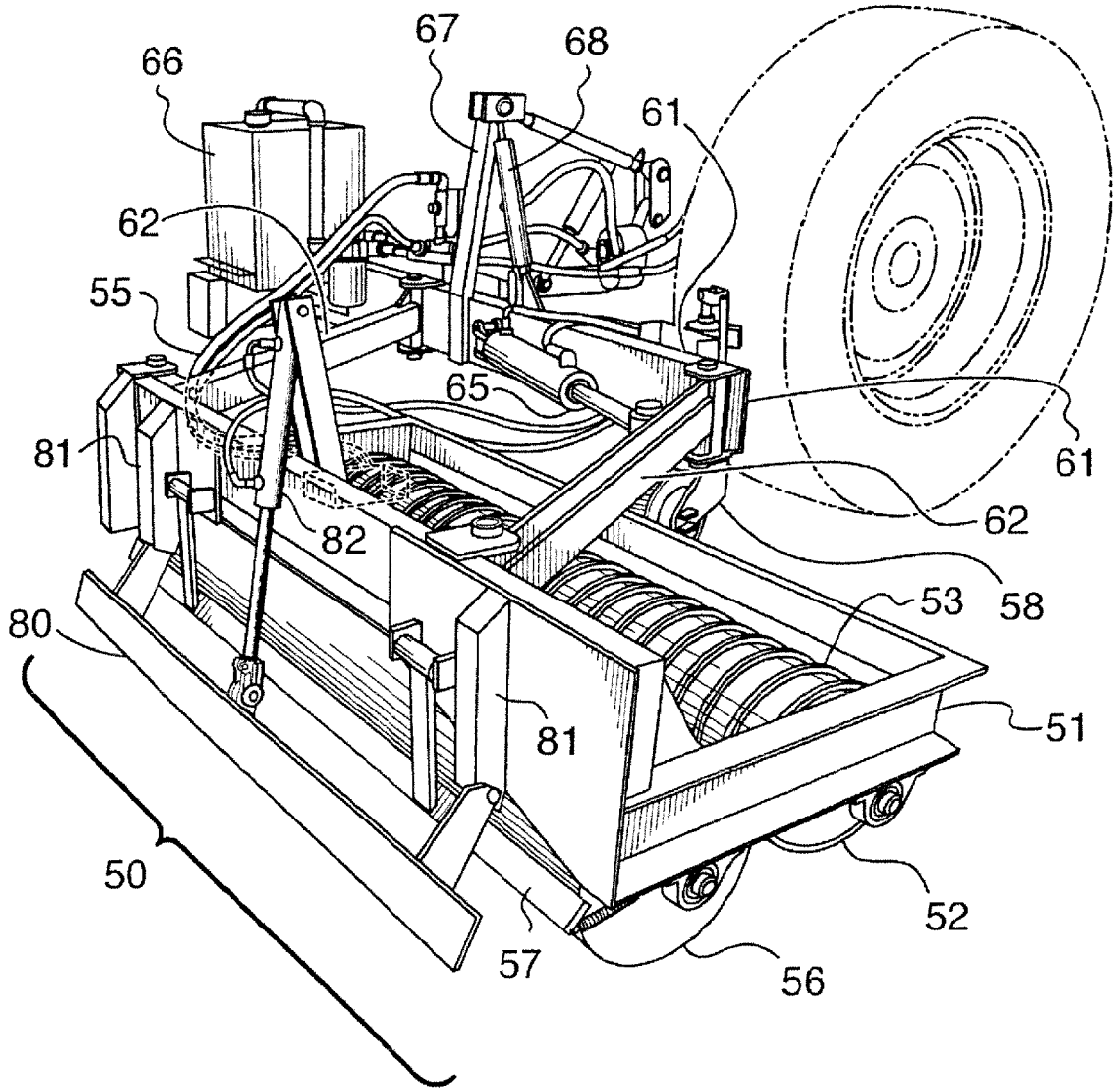
FIG. 10*b* is a perspective view showing the embodiment from FIG. 10*a* in a deployed position.

As shown in FIGS. 10*a* and 10*b*, the road-shoulder grooming component 50 may be optionally provided with a rearward facing grader blade 80 that is hingably mounted to the framework 51 with hinge elements 81. A hydraulic cylinder 82 is interposed the grader blade 80 and the framework 51 to enable operator-controlled raising and lowering of the grader blade 80. The optional rear-ward facing grader blade 80 is particularly useful for additional working and grooming of deeply rutted or pot-holed portions of road shoulders.

Figure 11:
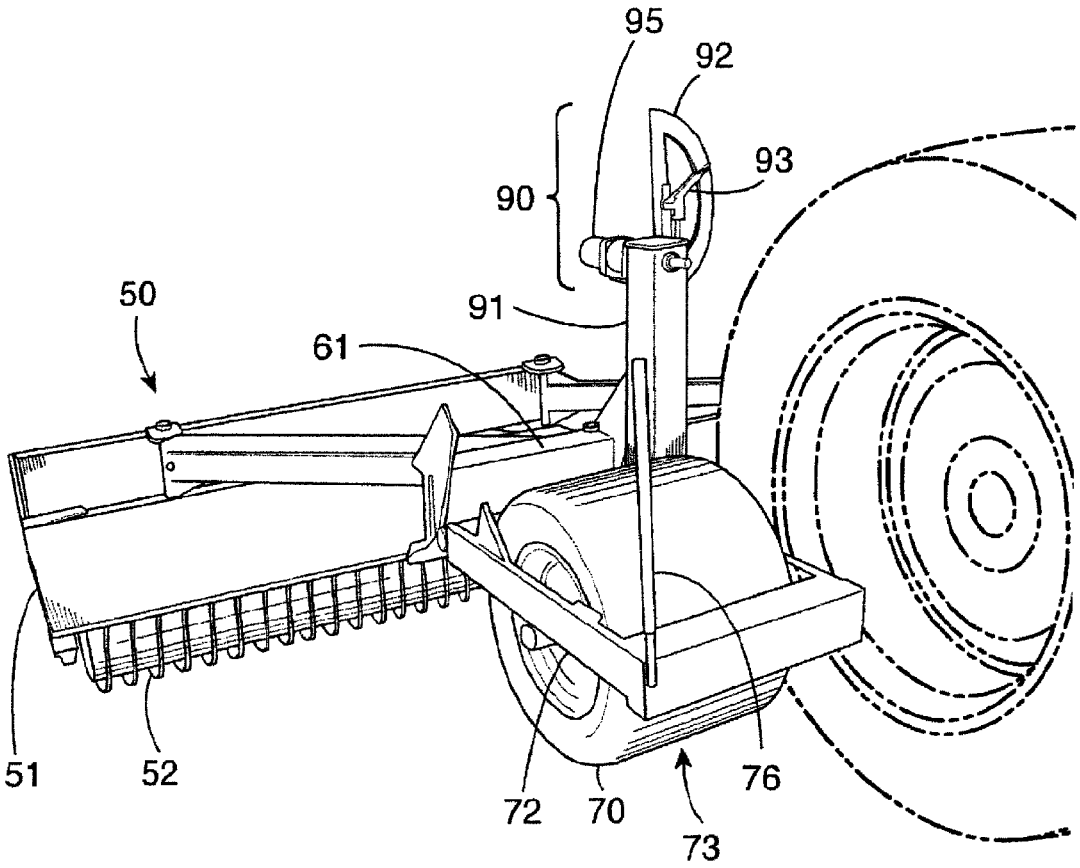
FIG. 11 is a perspective view from the front showing an exemplary embodiment for a device configured for enabling precise positioning adjustment of the road shoulder-grooming component of the present invention.
Figure 12:
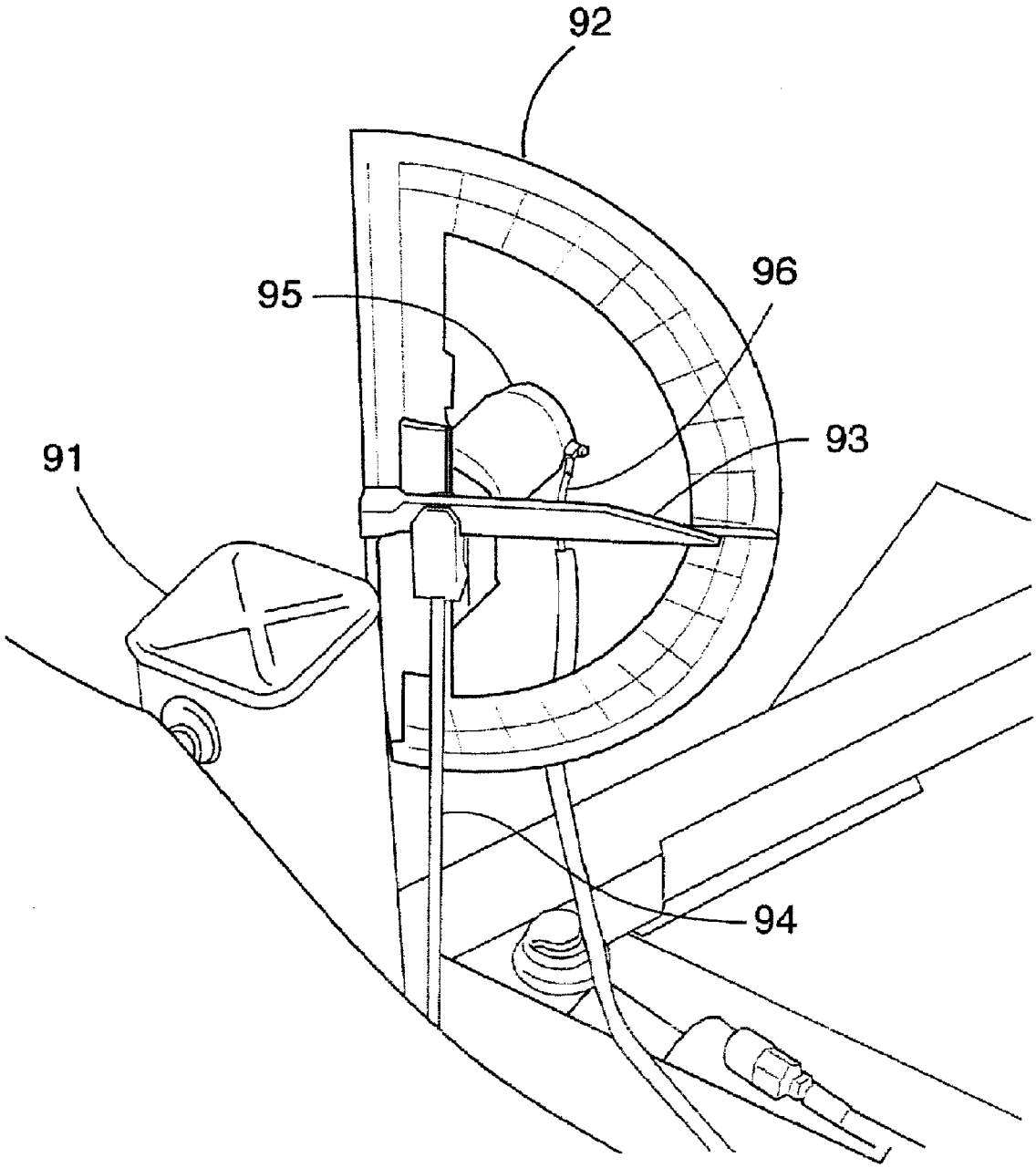
FIG. 12 is a close-up perspective view of an aspect of the positioning adjustment device shown in FIG. 11.
Figure 13:
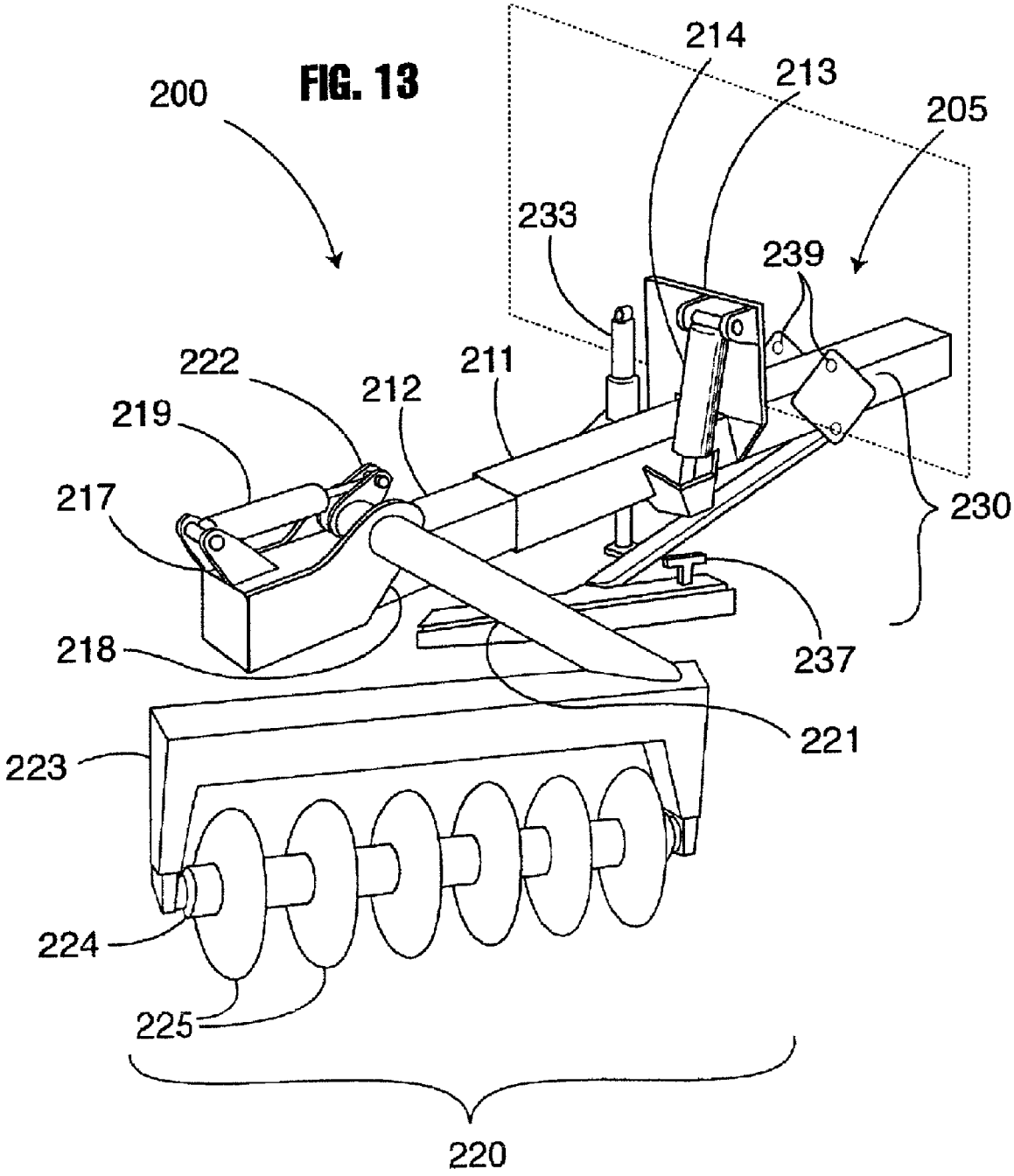
FIG. 13 is a perspective view from the front, of another exemplary embodiment for a road shoulder-engaging component of present invention.
Figure 14:
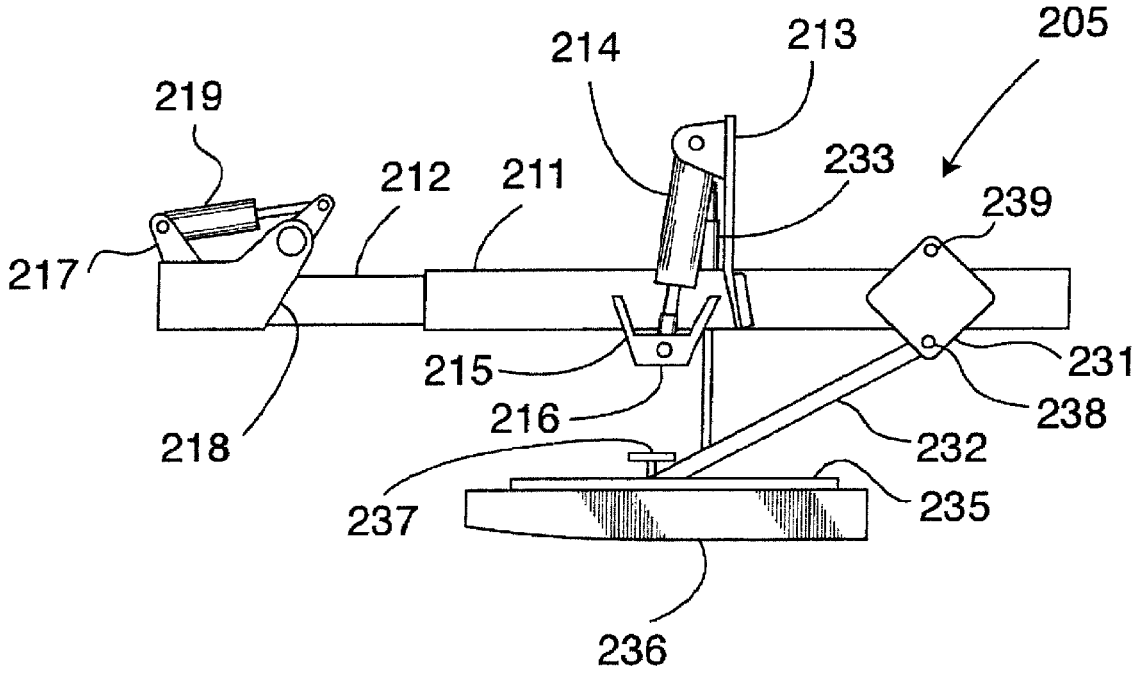
FIG. 14 is a partial front view of the embodiment shown in FIG. 13, showing the mouldboard deployed downward.
Figure 15:
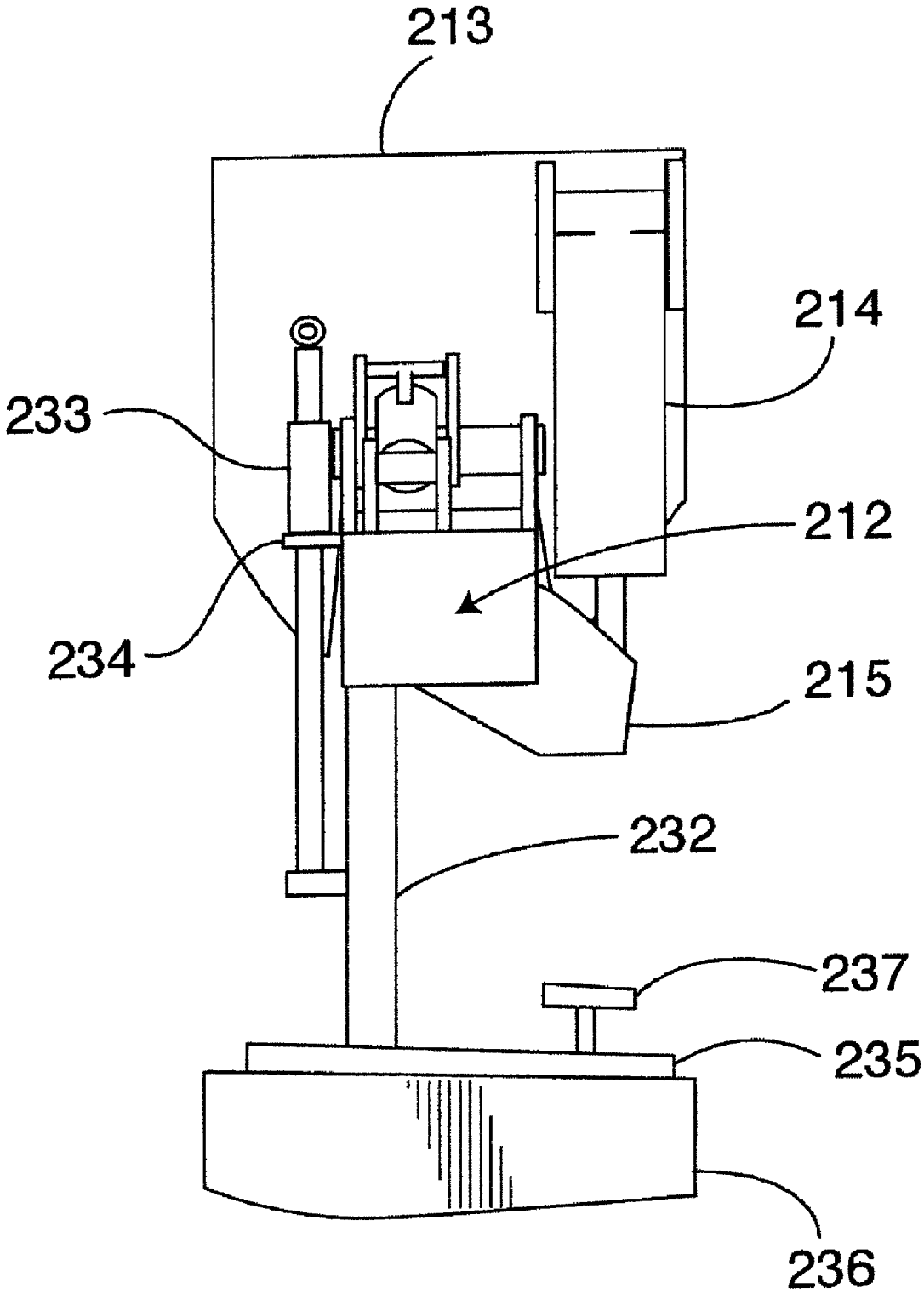
FIG. 15 is a partial end view of the embodiment shown in FIG. 14.
Figure 16:
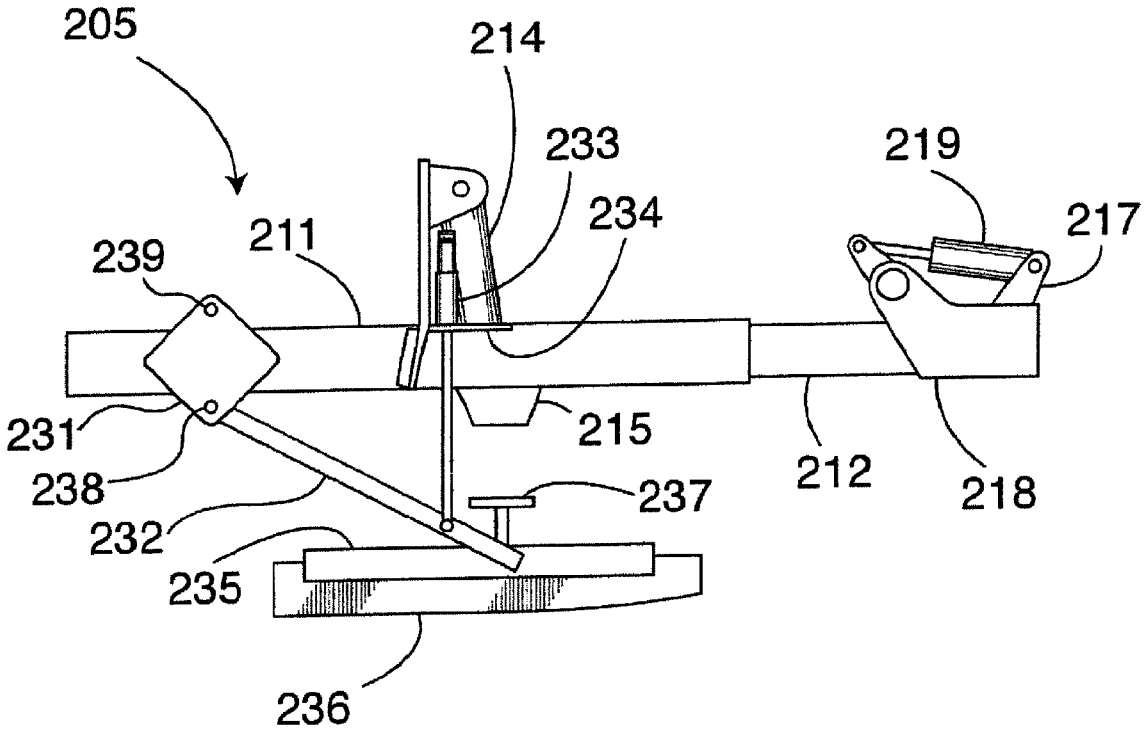
FIG. 16 is a partial rear view of the embodiment shown in FIG. 14.
Figure 17A:
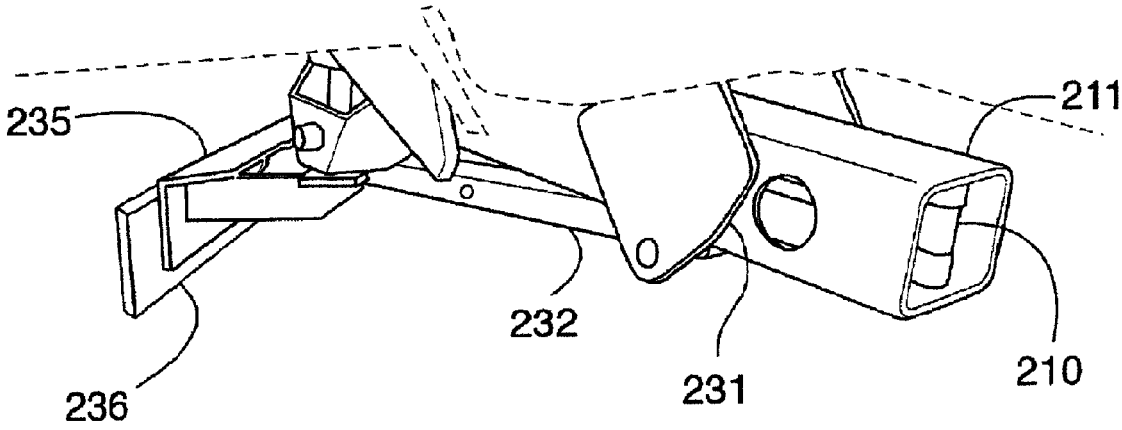
FIG. 17*a* is a perspective view of the opposite end of the view in FIG. 15, showing mouldboard in a retracted position.
Figure 17B:
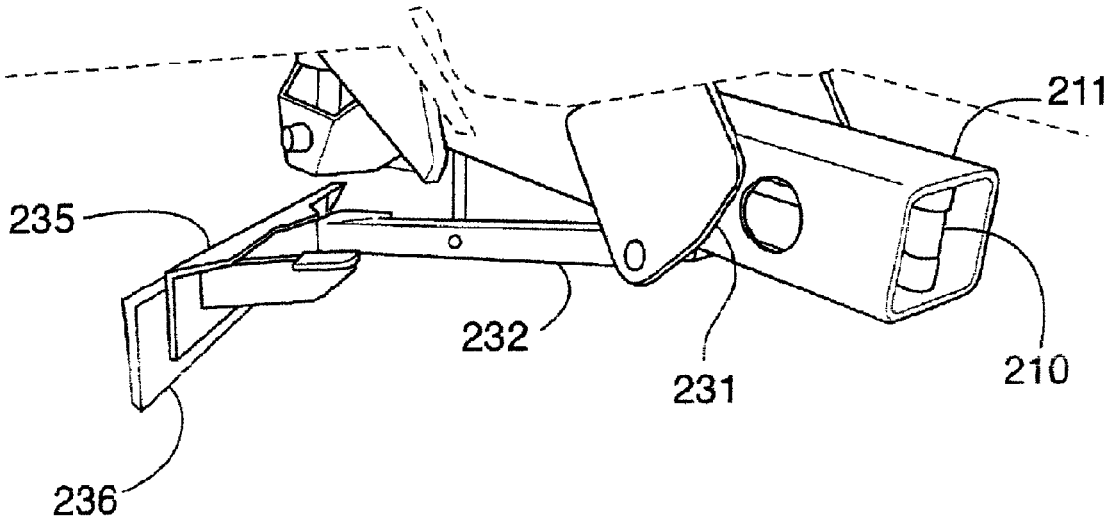
FIG. 17*b* is a perspective view of the opposite end of the view in FIG. 15, showing mouldboard in deployed downward.

It is desirable when grooming road shoulders to provide a firmly compacted shoulder surface that is level with the road surface. A compacted shoulder surface that is lower than the adjacent road surface may cause vehicles to sharply vear toward and off the road shoulder as they pull off the road surface. Compacted road shoulders with surfaces that are slightly higher than the adjacent road surfaces will over a period of time and use, result in the road shoulder materials deflecting onto the road surface thereby creating potentially hazardous road surface conditions. Therefore, as shown in FIGS. 11 and 12, the road-shoulder grooming component 50 of the present invention may be further optionally provided with an apparatus 90 configured and positioned to enable the operator to precisely adjust the height of the augured leading roller 52 so that the granular materials worked by the augured leading roller 52 are raised to a preferred height above the road surface to enable the smooth-faced following roller 56 to compact the granular material to a height that is level with the adjacent road surface. The road shoulder height adjusting apparatus 90 is mounted at the upper end of a generally vertically orientated support element 91 securely interconnected at its bottom end to the framework 51. The road shoulder height adjusting apparatus 90 comprises an electrical motor 95 mounted proximate the top of the support element 91, said electrical motor 95 controllable by the operator via wiring 96, said electrical motor interconnected to an electrically controlled actuator (not shown) configured to controllably cooperate with a height-adjusting assembly (not shown) mounted on the framework 51, said height-adjusting assembly configured to controllably raise and lower the augured leading roller 52. The road shoulder height adjusting apparatus 90 further comprises a gauge 92 cooperating with an indicator 93 interconnected to the height-adjusting assembly by a sending device 94. The operator is able to determine "on-the-fly" from the position of the indicator 93 relative to the gauge 92, the height of the augured leading roller 52 relative to the road surface, and may controllably manipulate the electrical motor 95 to raise or lower the augured leading roller 52 as required to provide a compacted road shoulder surface that is level with the adjacent road surface.

In operation, the first component 20 of the road shoulder working, grooming and compacting apparatus 15 is laterally deployed from a machine 10 travelling along a road surface adjacent to a road shoulder region, by actuating hydraulic cylinder 130, and then is pivotably engaged with the road shoulder by concurrently and independently actuating hydraulic cylinders 153 and 39 thereby causing the road-shoulder engaging component 20 to work the road shoulder and urge granular aggregate materials toward and onto the road surface. The mouldboard 32 of the second component i.e., the road-shoulder transfer component 30 is lowered to slidingly communicate with the road surface thereby transferring the granular aggregate materials deposited onto the road surface by the road-shoulder grooming component 20, back onto the road shoulder region. The optional rotary broom device 45 may be lowered to brushingly communicate with the road surface to brush any granular aggregate materials left behind the second component 30 back onto the road shoulder region. The third i.e. the road-shoulder grooming component 50 is laterally deployed outboard of machine 10 by actuating hydraulic cylinder 65 and then lowered by three-point hitch 65 to rotatingly engage the road shoulder with leading roller 52 provided with augered surface 53 to evenly distribute and groom granular aggregate materials across the surface of the road shoulder region. Any clumps of vegetation and other large objects such as rocks, debris, cans etc. present on or near the road shoulder surface will be transferred by the augered surface 53 of the leading roller 52 to the outboard edge of framework 51 and then will be discharged sideways therefrom beyond the outer edge of the road shoulder region. The height of the worked road shoulder provided by the augured leading roller 52 may be controllably adjusted with an optional road shoulder height adjusting apparatus 90. The following smooth-faced roller 56 will compact the groomed road shoulder. We have found that providing an upwardly inclined slope of granular aggregate material on the road shoulder region immediately adjacent the edge of the road surface prior to compacting results in a very densified portion of road shoulder immediately adjacent the road surface after compacting. Such a densified road shoulder portion facilitates safer egress of vehicles onto the road shoulder region at speed and also, is more resistant to damage caused by heavy rainfalls and weathering. If so desired to provide a firmer road shoulder, an optional packing wheel assembly 73 may be provided in front of the road-shoulder grooming component 50 (FIGS. 1 and 11). A suitable packing wheel assembly 73 (FIG. 11) comprises a framework 72 containing therein a packing wheel 70 provided with an axle 71 rotationally cooperating at each end with a bearing device (not shown) provided therefore on the framework 72. The packing wheel assembly 73 may be optionally provided with vertical marker device 76 mounted onto a corner of the framework 72. After the road shoulder working, grooming and compacting operations are completed, the four components are raised, then the first and third components are laterally retracted for transport. It is to be understood that the individual components comprising the road shoulder working, grooming and compacting apparatus 15 of the present invention are useful when used alone and therefore it is within the scope of this invention, for example, to demountably couple the road-shoulder grooming component 50 to the rear of a suitable machine for grooming and compacting road shoulders. Alternatively, it is also within the scope of the present invention to provide a unit comprising the road-shoulder engaging component 20 interconnected and cooperating with the road-shoulder transfer component 30 as described herein for demountably coupling to a suitable machine for working road shoulders.

An another exemplary embodiment road-shoulder engaging and transfer unit 200 of the present invention is shown in FIGS. 13 to 17 and generally comprises a laterally-extendable boom assembly 205 provided with a controllably articulable road-shoulder engaging component 220 about the distal end of the boom assembly 205 and a controllably deployable mouldboard assembly 230.

The exemplary boom assembly 205 shown in FIGS. 13 to 17 comprises an outer tubular housing 211, an inner extendable-retractable shaft 212, and a hydraulic cylinder (not shown) mounted inside the outer tubular housing 211 with the piston end of the hydraulic cylinder interconnected with the proximal end of the shaft 212. A yoke-shaped bracket 218 is provided approximate the distal end of the shaft 212, and is configured to receive therethrough and to cooperate therewith a support arm 221 extending backward from the proximal end of the framework 223 of the road-shoulder engaging component 220. A second bracket 217 is provided about the distal end of the shaft 212 and is configured to pivotably engage one end of a hydraulic cylinder 219. The other end of the hydraulic cylinder is configured to pivotably engage a bracket 222 mounted onto the support arm interposed the yoke of bracket 218. Manipulable operation of the hydraulic cylinder 219 will cause the support arm to rotate back and forth about a horizontal axis thereby raising and lowering the distal end of the framework 223 relative to the proximal end of the framework 233. The framework 223 of the road-shoulder engaging component 220 is configured to receive and cooperate with an axle member 224 provided with a plurality of spaced apart concave rotatable discs 225.

The road-shoulder engaging and transfer unit 200 is demountably engagable with a operator-controlled self-propelled machine as exemplified by a farm tractor (not shown), by a first mounting plate 213 and a pair of mounting brackets 231. The first mounting plate 213 is configured to pivotably engage one end of a hydraulic cylinder 214. A bracket 215 is provided on the outer tubular housing 211 of the boom assembly 205, for engaging the other end of the hydraulic cylinder 214. A pair of opposing mounting brackets 231, each provided with an upper aperture 239 and a lower aperture 238, is provided approximate the proximal end of outer tubular housing 211 of the boom assembly 205, for pivotable demountable attachment to the undercarriage of the self-propelled equipment with a pin or bolt communicating and cooperating with upper apertures 239 and the undercarriage of the self-propelled equipment. Manipulable operation of the hydraulic cylinder 214 will cause raising and lowering of the distal end of the boom assembly 205 relative to the pair of mounting brackets 231 that are pivotably engaged with the undercarriage of the self-propelled equipment.

The mouldboard assembly 230 comprises a support arm 232 pivotably engaged at its proximal end with the bottom apertures 238 of opposing brackets 231, a mouldboard supporting frame element 235 pivotably engaged with the distal end of the support arm 232, a mouldboard 236 attached to the mouldboard supporting frame element 235, a hydraulic cylinder 233 secured approximate one end to a bracket 234 mounted onto the outer tubular housing 211 opposite 215 bracket while the other end of the hydraulic cylinder is pivotably attached to the support arm 232. A stop 237 having a flat upper surface, is mounted on the mouldboard supporting frame element 235 such that the upper surface of the stop 237 contacts and cooperates with the flat bottom surface 216 of mounting bracket 215 when the mouldboard assembly 230 is in a raised position Prior to moving an operator-controlled self-propelled machine equipped with the road-shoulder engaging and transfer unit 200 between work sites, the boom assembly 205 must be in a full raised and retracted position underneath the self-propelled machine, with the framework 223 of the road-shoulder engaging component 220 moved to a generally horizontal position. The mouldboard assembly 230 must also be in a fully raised position. When the self-propelled equipment has reached a work site, the boom assembly 205 is extended so that the rotatable disc 225 nearest to the proximal end of the framework 223 of the road-shoulder engaging component 220 is positioned over a portion of the road shoulder adjacent the road surface. The boom assembly 205 is then lowered to engage the plurality of rotatable discs 225 with the road shoulder, and the mouldboard assembly 230 is lowered until the mouldboard 236 is in sliding communication with the road surface. The self-propelled machine is then operated to engage the road shoulder region thereby transferring aggregate materials to the road surface which are then transferred back to the road shoulder region by the mould board assembly 230. The framework 233 of the road-shoulder engaging component 220 can be controllably pivoted as required by the operator's manipulation of the hydraulic cylinder 219 to ensure the desired working of the road shoulder by the road-shoulder engaging component 220 is achieved.

Figure 18:
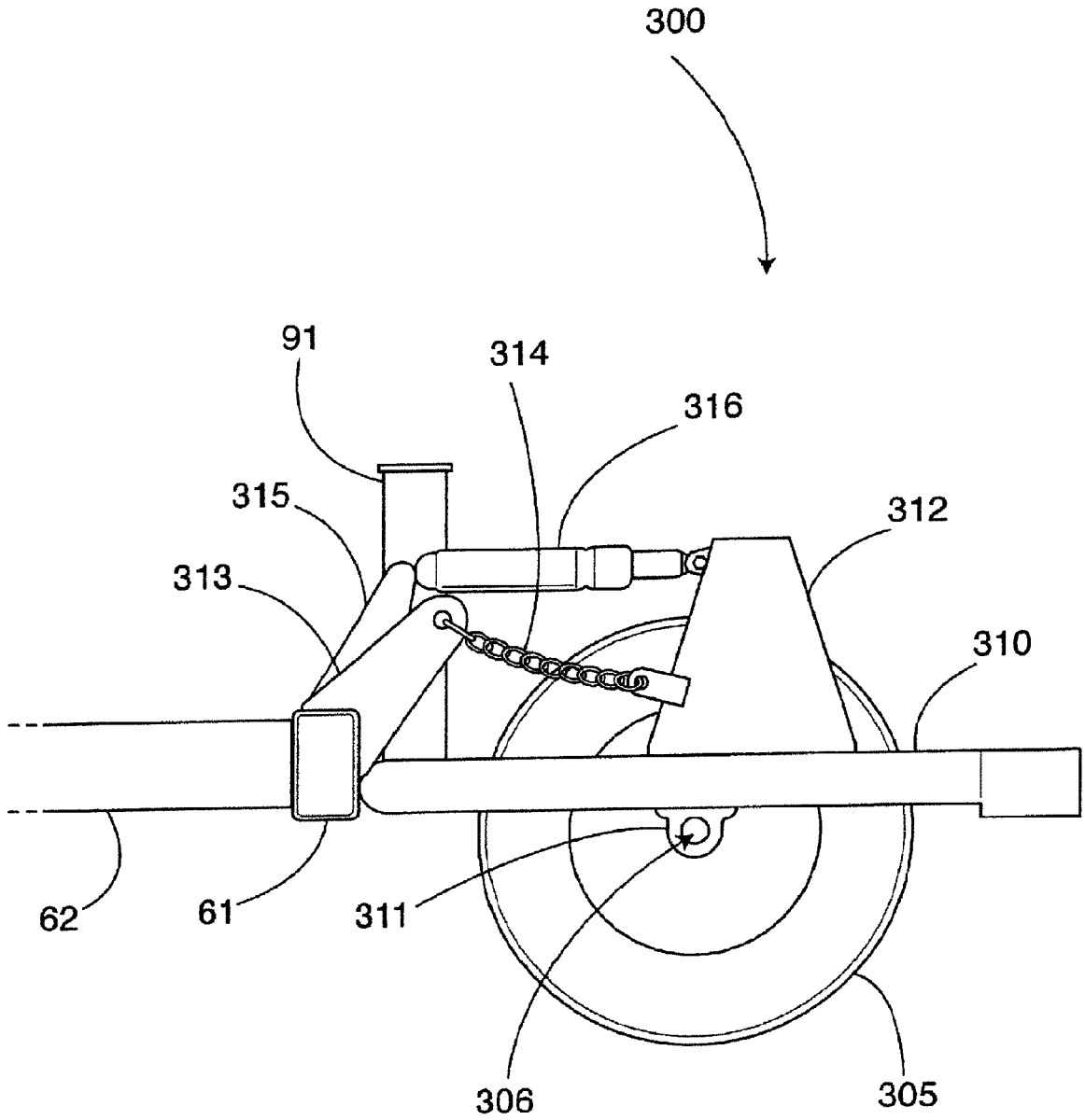
FIG. 18 is an end view showing another exemplary embodiment for a packing wheel assembly according to the present invention.

An alternative exemplary embodiment of the packing wheel assembly of the present invention is illustrated in FIG. 18. The packing wheel assembly 300 generally comprises a framework 310 pivotably interconnected with the framework 61 of the road-shoulder grooming component 50 (exemplified in FIGS. 1 and 2) and a freely-rotatable packing wheel 305 mounted onto an axle 306 rotatingly communicable with bearing devices 311 provided therefore on the packing wheel framework 310. The framework 310 comprises a pair of side rails, a front rail and a bridging frame rail structure 312. The bridging frame rail structure 312 comprises a vertical element extending upward from each side rail and a horizontal frame rail integrally bridging the two vertical elements. A bracket 315 is integrally engaged with the framework 61 of the road-shoulder grooming component 50 behind the packing wheel assembly 300, and is configured to pivotably engage one end of a hydraulic cylinder 316. The other end of the hydraulic cylinder 316 is pivotably engaged with the bridging frame rail structure 312. During operation when the road-shoulder engaging component of the present invention is working and transferring aggregate materials from the road shoulder onto the road surface and then back the onto road shoulder region immediately adjacent the road surface, additional packing force can be applied to the packing wheel 305 by extending the piston of the hydraulic cylinder 316 thereby applying a downward force on the a bridging frame rail structure 312 of the framework 310. Another bracket 313 is optionally provided on beam 61 for receiving and retaining one end of a chain 314. The other end of the chain 314 is connected to a bracket provided therefore on the bridging frail rail structure 312. When the packing wheel assembly 300 is raised for transport from the work site, the chain 314 will prevent the packing wheel from unexpectedly dropping to the road surface during transport.

Figure 19:
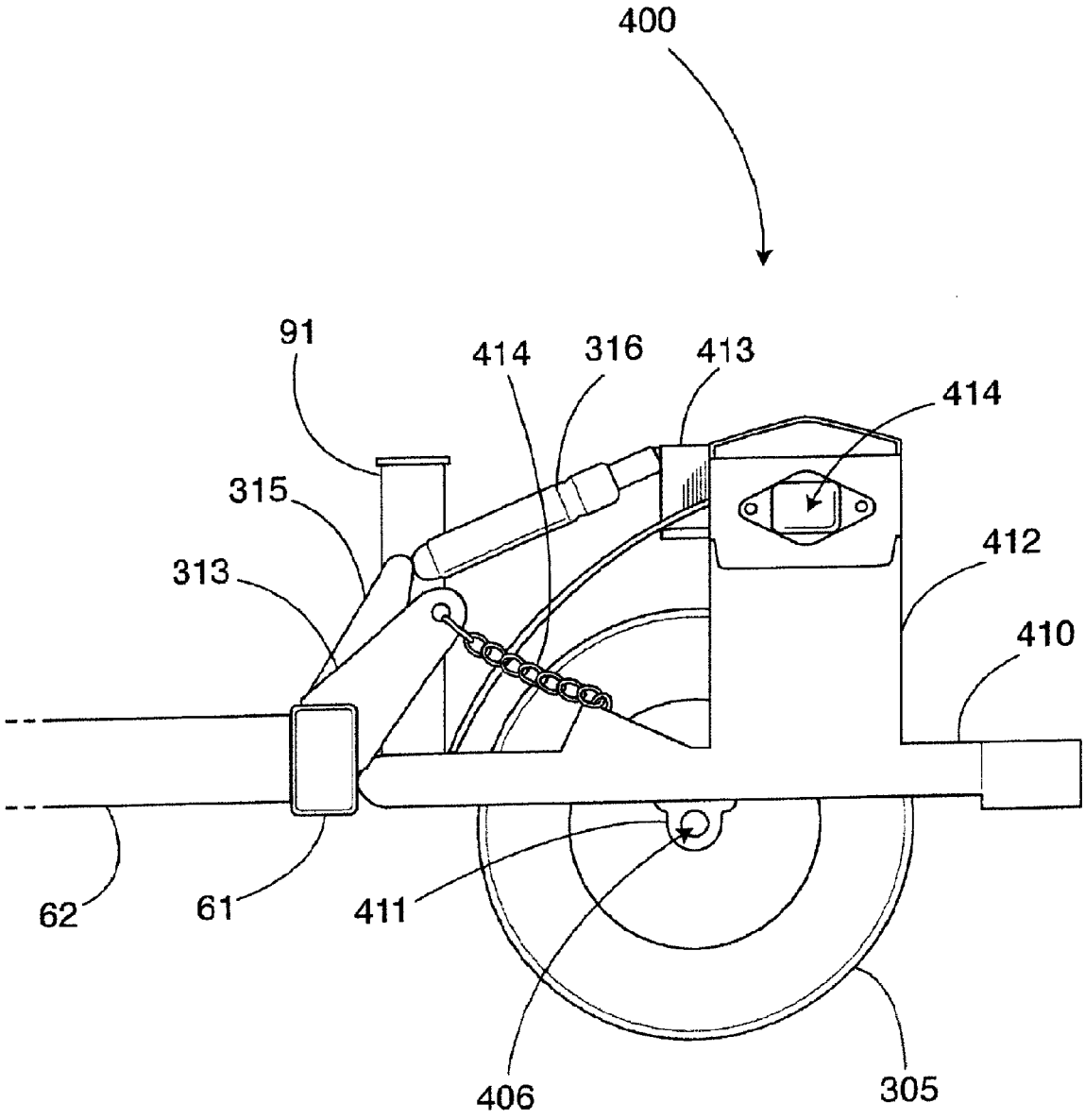
FIG. 19 is an end view showing an alternative exemplary embodiment for a packing wheel assembly according to the present invention.

Another alternative exemplary embodiment of the packing wheel assembly of the present invention is illustrated in FIG. 19. The packing wheel assembly 400 generally comprises a framework 410 pivotably interconnected with the framework 61 of the road-shoulder grooming component 50 (exemplified in FIGS. 1 and 2) and a freely-rotatable packing wheel 305 mounted onto an axle 406 rotatingly communicable with bearing devices 411 provided therefore on the packing wheel framework 410. The framework 410 comprises a pair of side rails, a front rail and a bridging frame rail structure 412. The bridging frame rail structure 412 comprises a vertical element extending upward from each side rail and a horizontal frame rail integrally bridging the two vertical elements. A bracket 315 is integrally engaged with the framework 61 of the road-shoulder grooming component 50 behind the packing wheel assembly 400, and is configured to pivotably engage one end of a hydraulic cylinder 316. The other end of the hydraulic cylinder 316 is pivotably engaged with a bracket 413 extending backward from the bridging frame rail structure 412. A vibratory motor assembly 414 is mounted into the bridging frame rail structure 412. During operation when the road-shoulder engaging component of the present invention is working and transferring aggregate materials from the road shoulder onto the road surface and then back the onto road shoulder region immediately adjacent the road surface, additional packing force can be applied to the packing wheel 305 by extending the piston of the hydraulic cylinder 316 thereby applying a downward force on the a bridging frame rail structure 412 of the framework 410. Additional downward force is applied by concurrently operating the vibratory motor assembly 414 thereby causing the packing wheel 305 to vibrate up and down. Another bracket 313 is optionally provided on beam 61 for receiving and retaining one end of a chain 414. The other end of the chain 414 is connected to a bracket provided therefore on the 410. When the packing wheel assembly 400 is raised for transport from the work site, the chain 414 will prevent the packing wheel from unexpectedly dropping to the road surface during transport.

Figure 20:
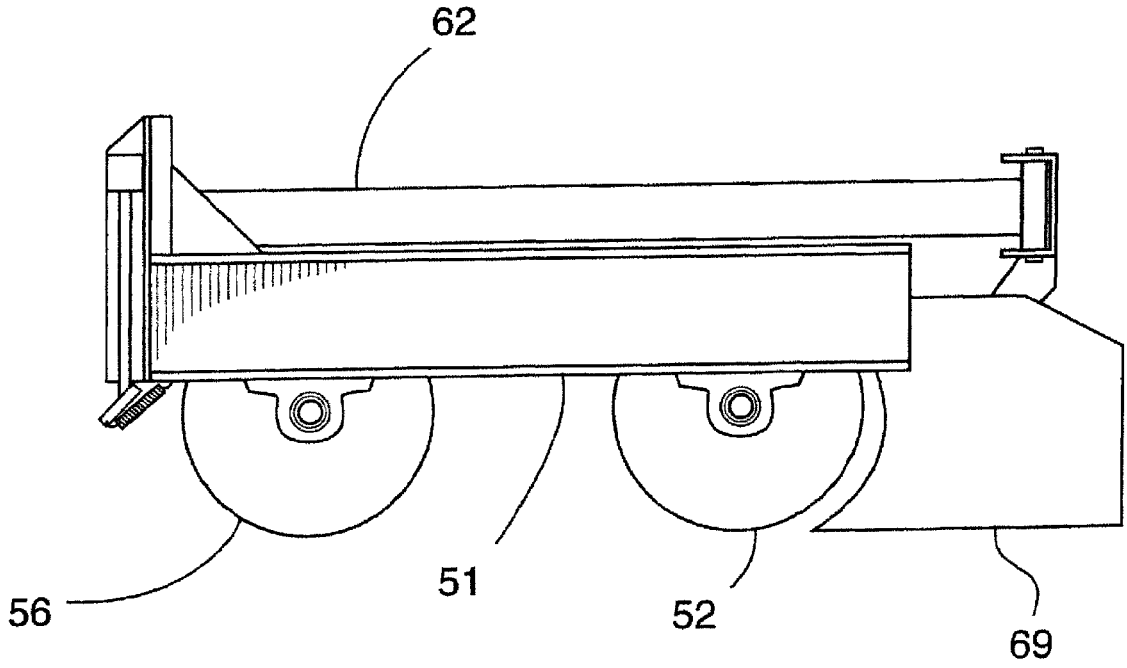
FIG. 20 is an end view showing an optional aspect of an exemplary road grooming component of the present invention.

FIG. 20 illustrates an optional side-edge plate component 69 that may be provided with the road-shoulder grooming apparatus 50 of the present invention. The side-edge plate component may be attached to the leading edge on the right side of the framework 51. The bottom of the side-edge rail component 69 is configured to extend slightly below the bottom of the leading roller 52. During operation, the side-edge rail component 69 will catch and retain the aggregate being moved sideways by the leading roller 52 which will then redistribute the retained aggregate across the road shoulder.

While this invention has been described with respect to the preferred embodiments, it is to be understood that various alterations and modifications can be made to components of the road shoulder working, grooming and compacting apparatus within the scope of this invention, which are limited only by the scope of the appended claims.

The invention claimed is:

1. A road shoulder working, grooming and compacting apparatus configured for demountably cooperating with a self-propelled operator-controlled machine, the apparatus comprising:

a first component provided with an outwardly extendable and retractable boom assembly having mounted thereon a plurality of cooperating devices for engaging, disrupting and urging granular aggregate materials from an outer portion of a road shoulder region toward and partially onto an adjacent road surface, said boom assembly being movable between a retracted upwardly and inwardly raised position and a laterally-extended and lowered engaged position wherein the cooperating devices are arranged to engage the outer portion of the road shoulder region;

a second component pivotably and cooperably mounted onto the boom assembly, said second component provided with a structural support cooperating with a mouldboard for transferring granular aggregate materials from the road surface onto the road shoulder region, the structural support movable in a vertical axis between a raised retracted position and a lowered engaged position whereby the mouldboard slidingly communicates with the road surface, the second component positioned posterior to the first component; and a third component provided with a framework mounting therein a plurality of rotatable cooperating devices extending therefrom for evenly distributing and grooming said granular aggregate materials across the road shoulder region and for compacting the groomed road shoulder region, said framework movable between a retracted upward and inward raised position and a laterally-deployed and lowered engaged position wherein the rotatable cooperating devices are arranged to engage and work the road shoulder region, the third component positioned posterior to the second component.

2. The apparatus of claim 1 additionally provided with a fourth component interposed between the second component and the third component, the fourth component comprising a rotary broom device for sweeping granular aggregate materials left on the road surface by the second component, onto the road shoulder region, said rotary broom device movable in a vertical axis between a retracted raised position and a lowered engaged position whereby the device brushingly communicates with the road surface.

3. The apparatus of claim 1 provided with a plurality of cooperating hydraulically controlled actuators for concurrently but independently: (a) laterally disposing the first and third components cooperating with self-propelled operator-controlled machine on the road surface therefrom to the road shoulder region, (b) controlling the engagement of said laterally disposed components therewith the road shoulder portion, (c) retraction of said first and third components therefrom, (d) controlling the communication of the second component with the road surface, and (e) retraction of the second component therefrom.

4. The apparatus of claim 1, additionally provided with a fourth component in front of said third component, the fourth component comprising a packing wheel assembly, said packing wheel assembly controllably movable in a vertical axis between a retracted raised position and a lowered engaged position.

5. The apparatus of claim 4, additionally configured with a hydraulically controlled actuator for raising and lowering said fourth component.

6. The apparatus of claim 4, wherein the packing wheel assembly is provided with a hydraulic device for controllably applying a downward pressure when said packing wheel assembly is deployed in an operational position.

7. The apparatus of claim 4, wherein the packing wheel assembly is provided with a vibratory motor assembly, said vibratory motor assembly controllably operational when said packing wheel assembly is deployed in an operational position.

8. The apparatus of claim 2 provided with a plurality of cooperating hydraulically controlled actuators for concurrently but independently: (a) laterally disposing the first and third components cooperating with self-propelled operator-controlled machine on the road surface therefrom to the road shoulder region, (b) controlling the engagement of said laterally disposed components therewith the road shoulder portion, (c) retraction of said first and third components therefrom, (d) controlling the communication of the second and fourth component with the road surface, and (e) retraction of the second and fourth components therefrom.

9. The apparatus of claim 1 wherein the first component and the third component are each configured to separately demountably engage an undercarriage of the self-propelled operator-controlled machine.

10. The apparatus of claim 1 wherein the plurality of cooperating devices mounted thereon the frame of said first component comprises a plurality of substantially parallel spaced apart discs, each disc provided with a cutting edge about its periphery arranged to engage the road shoulder for digging up and urging granular aggregate material towards the road surface when said first component is engaged with the road shoulder region.

11. The apparatus of claim 1 wherein the second component is provided with the mouldboard comprising a bottom edge having an upward inclined distal end portion.

12. The apparatus of claim 1 wherein the mouldboard is provided with a concave forward-facing face along its longitudinal axis, the mouldboard further provided with a flat bottom edge surface.

13. The apparatus of claim 1 wherein the third component is provided with the framework having mounted therein a leading elongate augering roller and a following compacting roller, said rollers configured for movably engaging a worked road shoulder region for distributing, grooming and compacting granular aggregate materials there across the road shoulder region from the road surface edge to the outer portion of the road shoulder region when said third component is laterally disposed in an engaged position from the self-propelled operator-controlled machine travelling along the road surface adjacent said road shoulder region.

14. The apparatus of claim 13 wherein the angering roller is provided with a drive means interconnected with one of the augering roller for rotating said augering roller in a direction opposite to the direction of travel of said self-propelled operator-controlled machine, said framework additionally having mounted therein a following compacting roller for compacting said groomed road shoulder region.

15. The apparatus of claim 13 additionally provided with an actuator configured for controllably raising and lowering said augering roller along a vertical axis.

16. The apparatus of claim 13 wherein the compacting roller is a vibratory compacting roller.

17. The apparatus of claim 13 wherein the compacting roller provided with a longitudinally extending scraper blade having a cleaning edge cooperating with said roller for removing material from an outer surface of the roller, the scraper blade adjustably interconnected said framework.

18. The apparatus of claim 13 additionally provided with a rear-ward facing grader blade, said grader blade controllably movable in a vertical axis between a retracted raised position and a lowered engaged position.

19. The apparatus of claim 13, wherein the framework is provided with a side-edge plate extending outward and downward from the leading front corner of the framework positional about the distal edge of a road shoulder to be worked.

20. An apparatus for working, grooming and compacting road shoulders, the apparatus comprising:

a self-propelled operator-controlled machine;

a first component provided with an outwardly extendable and retractable boom assembly having mounted thereon a plurality of cooperating devices for engaging, disrupting and urging granular aggregate materials from an outer portion of a road shoulder region toward and partially onto an adjacent road surface, said boom assembly being movable between a retracted upwardly and inwardly raised position and a laterally-extended and lowered engaged position wherein the cooperating devices are arranged to engage the outer portion of the road shoulder region;

a second component pivotably and cooperably mounted onto the boom assembly, said second component provided with a structural support cooperating with a mouldboard for transferring granular aggregate materials from the road surface onto the road shoulder region, the structural support movable in a vertical axis between a raised retracted position and a lowered engaged position whereby the mouldboard slidingly communicates with the road surface, the second component positioned posterior to the first component; and a third component provided with a framework mounting therein a plurality of rotatable cooperating devices extending therefrom for evenly distributing and grooming said granular aggregate materials across the road shoulder region and for compacting the groomed road shoulder region, said framework movable between a retracted upward and inward raised position and a laterally-deployed and lowered engaged position wherein the rotatable cooperating devices are arranged to engage and work the road shoulder region, the third component positioned posterior to the second component, whereby the self-propelled operator-controlled machine is navigable to travel on the road surface wherefrom the first component is laterally disposed to engage and urge granular aggregate materials from the outer portion of the road shoulder region toward and partially onto the road surface wherefrom the granular aggregate materials are transferred by the second component onto the road shoulder region whereto the third component is laterally disposed for distributing, grooming, and compacting of said granular aggregate materials.

21. The apparatus of claim 20 additionally provided with a fourth component interposed between the second component and the third component, the fourth component comprising a rotary broom device for sweeping granular aggregate materials left on the road surface by the second component, onto the road shoulder region, said rotary broom device movable in a vertical axis between a retracted raised position and a lowered engaged position whereby the device brushingly communicates with the road surface.

22. The apparatus of claim 20 provided with a plurality of cooperating hydraulically controlled actuators for concurrently but independently: (a) laterally disposing the first and third components cooperating with self-propelled operator-controlled machine on the road surface therefrom to the road shoulder region, (b) controlling the engagement of said laterally disposed components therewith the road shoulder portion, (c) retraction of said first and third components therefrom, (d) controlling the communication of the second component with the road surface, and (e) retraction of the second component therefrom.

23. The apparatus of claim 20, additionally provided with a fourth component in front of said third component, the fourth component comprising a packing wheel assembly, said packing wheel assembly controllably movable in a vertical axis between a retracted raised position and a lowered engaged position.

24. The apparatus of claim 23, additionally configured with a hydraulically controlled actuator for raising and lowering said fourth component.

25. The apparatus of claim 23, wherein the packing wheel assembly is provided with a hydraulic device for controllably applying a downward pressure when said packing wheel assembly is deployed in an operational position.

26. The apparatus of claim 23, wherein the packing wheel assembly is provided with a vibratory motor assembly, said vibratory motor assembly controllably operational when said packing wheel assembly is deployed in an operational position.

27. The apparatus of claim 21 provided with a plurality of cooperating hydraulically controlled actuators for concurrently but independently: (a) laterally disposing the first and third components cooperating with self-propelled operator-controlled machine on the road surface therefrom to the road shoulder region, (b) controlling the engagement of said laterally disposed components therewith the road shoulder portion, (c) retraction of said first and third components therefrom, (d) controlling the communication of the second and fourth component with the road surface, and (e) retraction of the second and fourth components therefrom.

28. The apparatus of claim 20 wherein the first component and the third component are each configured to separately demountably engage an undercarriage of the self-propelled operator-controlled machine.

29. The apparatus of claim 20 wherein the plurality of cooperating devices mounted thereon the frame of said first component comprises a plurality of substantially parallel spaced apart discs, each disc provided with a cutting edge about its periphery arranged to engage the road shoulder for digging up and urging granular aggregate material towards the road surface when said first component is engaged with the road shoulder region.

30. The apparatus of claim 20 wherein the second component is provided with the mouldboard comprising a bottom edge having an upward inclined distal end portion.

31. The apparatus of claim 20 wherein the mouldboard is provided with a concave forward-facing face along its longitudinal axis, the mouldboard further provided with a flat bottom edge surface.

32. The apparatus of claim 20 wherein the third component is provided with the framework having mounted therein a leading elongate augering roller and a following compacting roller, said rollers configured for movably engaging a worked road shoulder region for distributing, grooming and compacting granular aggregate materials thereacross the road shoulder region from the road surface edge to the outer portion of the road shoulder region when said third component is laterally disposed in an engaged position from the self-propelled operator-controlled machine travelling along the road surface adjacent said road shoulder region.

33. The apparatus of claim 32 wherein the augering roller is provided with a drive means interconnected with one of the angering roller for rotating said augering roller in a direction opposite to the direction of travel of said self-propelled operator-controlled machine, said framework additionally having mounted therein a following compacting roller for compacting said groomed road shoulder region.

34. The apparatus of claim 32 additionally provided with an actuator configured for controllably raising and lowering said augering roller along a vertical axis.

35. The apparatus of claim 32 wherein the compacting roller is a vibratory compacting roller.

36. The apparatus of claim 32 wherein the compacting roller provided with a longitudinally extending scraper blade having a cleaning edge cooperating with said roller for removing material from an outer surface of the roller, the scraper blade adjustably interconnected said framework.

37. The apparatus of claim 32 additionally provided with a rear-ward facing grader blade, said grader blade controllably movable in a vertical axis between a retracted raised position and a lowered engaged position.

38. The apparatus of claim 32, wherein the framework is provided with a side-edge plate extending outward and downward from the leading front corner of the framework positional about the distal edge of a road shoulder to be worked.

* * * * *